US011345580B2

(12) United States Patent
Comin et al.

(10) Patent No.: US 11,345,580 B2
(45) Date of Patent: May 31, 2022

(54) METHOD FOR FILLING CONTAINER WITH A GASIFIED LIQUID AND ASSOCIATED DEVICES

(71) Applicant: SOCIETE DES PRODUITS NESTLE S.A., Vevey (CH)

(72) Inventors: Andrea Comin, Nancy (FR); Damien Jean-Philippe Kannengiesser, Golbey (FR)

(73) Assignee: Societe des Produits Nestle S.A., Vevey (CH)

( * ) Notice: Subject to any disclaimer, the term of this patent is extended or adjusted under 35 U.S.C. 154(b) by 19 days.

(21) Appl. No.: 16/755,758

(22) PCT Filed: Oct. 12, 2018

(86) PCT No.: PCT/EP2018/077822
§ 371 (c)(1),
(2) Date: Apr. 13, 2020

(87) PCT Pub. No.: WO2019/076736
PCT Pub. Date: Apr. 25, 2019

(65) Prior Publication Data

US 2020/0277179 A1 Sep. 3, 2020

(30) Foreign Application Priority Data

Oct. 16, 2017 (EP) ..... 17196629

(51) Int. Cl.
*B67C 3/26* (2006.01)
*B67C 3/06* (2006.01)
*B67C 3/22* (2006.01)

(52) U.S. Cl.
CPC ..... *B67C 3/2614* (2013.01); *B67C 3/06* (2013.01); *B67C 3/225* (2013.01)

(58) Field of Classification Search
CPC .. B67C 3/06; B67C 3/10; B67C 3/225; B67C 3/2614
(Continued)

(56) References Cited

U.S. PATENT DOCUMENTS 5,339,874 A * 8/1994 Cragun ..... B67C 3/06 141/9
5,642,761 A 7/1997 Holbrook
(Continued)

FOREIGN PATENT DOCUMENTS

| | | |
|---|---|---|
| DE | 2408242 | 9/1975 |
| EP | 0375912 | 7/1990 |
| EP | 0775668 | 5/1997 |

*Primary Examiner* — Timothy L Maust
(74) *Attorney, Agent, or Firm* — K&L Gates LLP

(57) ABSTRACT

The invention concerns a method for filling a thermoplastic container (2), comprising a mouth (2*a*), with a gasified liquid having a pressure (P), said method using a filling unit (1) and comprising the steps of: —Positioning the container (2) under a filling head (3) of the filling unit (1), the filling head (3) comprising a product filling valve (8); —Establishing fluid tight connection between the filling head (3) and the mouth (2*a*) of the container (2); —Delivering a first volume of a first product (FL) in the container, said first volume being less than 10% of the maximum defined volume of the container; —Pressurizing the container (2) with a pressurized gas (G) at a pressure similar to the pressure (P) of the gasified liquid to be filled, using at least one pressurization valve (9*a*, 9*b*); —Filling the container (2) under pressurized condition until its maximum defined volume with the gasified liquid (PL), using the product filling valve (8); —Depressurizing the container (2) using a venting valve (10); —Separating the container (2) from the filling head (3); the resulting gasified liquid in the container (2) being a mixture of the first product (FL) and of the gasified liquid (PL). The invention is also related to the associated devices.

20 Claims, 12 Drawing Sheets

(58) Field of Classification Search
USPC ..... 141/57
See application file for complete search history.

(56) References Cited

U.S. PATENT DOCUMENTS

| | | | | |
|---|---|---|---|---|
| 6,189,578 | B1 * | 2/2001 | Clusserath | B67C 3/10 141/293 |
| 6,817,386 | B2 * | 11/2004 | Tsukano | B67C 3/04 141/57 |
| 7,464,732 | B2 * | 12/2008 | Nishino | B67C 3/04 141/144 |
| 7,647,950 | B2 * | 1/2010 | Clusserath | B67C 3/2628 141/56 |
| 8,091,591 | B2 * | 1/2012 | Knieling | B67C 3/2628 141/57 |
| 8,695,647 | B2 * | 4/2014 | Ruble | B67C 3/2628 141/147 |
| 8,714,209 | B2 * | 5/2014 | Hartel | B67C 3/281 141/48 |
| 9,809,436 | B2 * | 11/2017 | Clusserath | B67C 3/10 |
| 10,179,725 | B2 * | 1/2019 | Clusserath | G01F 1/582 |

* cited by examiner

METHOD FOR FILLING CONTAINER WITH A GASIFIED LIQUID AND ASSOCIATED DEVICES

CROSS REFERENCE TO RELATED APPLICATIONS

The present application is a National Stage of International Application No. PCT/EP2018/077822, filed on Oct. 12, 2018, which claims priority to European Patent Application No. 17196629.4, filed on Oct. 16, 2017, the entire contents of which are being incorporated herein by reference.

FIELD OF THE INVENTION

The invention relates to a method for filling a thermoplastic container such as a bottle with a gasified liquid such as sparkling or carbonated liquid.

The invention also relates to devices to implement and carry out the filling method of the invention.

The invention applies to any thermoplastic container and, for example, to containers made of polyethylene terephthalate (PET) (PET being bio-based or petro-based) which are filled with a gasified liquid such as carbonated or sparkling beverage like sparkling water, carbonated water based beverage or carbonated soft drinks.

Other thermoplastic material than PET may be used like polyethylene (PE), polyethylene furanoate (PEF) or any other suitable thermoplastic material that can be blow-molded and that is food grade.

BACKGROUND

The general principles of isobaric filling method have been known for a long time. A proposed isobaric filling method is described in European Patent Application EP 0 375 912 A1 in which part of the volume of the storage tank is filled with a liquid and the overlying other part is filled with a gas maintained at a pressure equal to the liquid saturation pressure. To fill the container, the container interior is put into communication with the tank via two pipes, a first of which opens into the upper part of the tank in the gas volume whereas the second pipe opens into the lower part of the tank in the liquid volume. In each pipe a shut-off valve is provided to close the relative pipe. To fill the bottle, the valve of the gas pipe is opened so that the gas flows into the container. While keeping the valve of the gas open, the valve of the liquid pipe is open so that the liquid fails into the container. Once reaching the filling level, the valves are stopped.

A recent generation of industrial machines for filling thermoplastic containers such as PET bottles, with carbonated and/or sparkling beverages, combines bottle blowing and filling into one single "blow-fill block" machine: in the first part of the machine, the bottle is stretch-blow molded and in the second part the bottle is filled and capped.

These machines are quite advantageous as they combine in a reduced space both forming (blow-molding) and filling of a container (bottle).

These machines are using isobaric filling valves. Isobaric filling valves are used to fill containers with carbonated liquid by putting the container under pressure and filling the container with the carbonated liquid while the container is still under pressure. The container is pressurized at a pressure similar to the pressure of the carbonated liquid. Conventionally, the container is pressurized at a pressure around 3 to 6 bars of added pressure in the case of sparkling water or carbonated drinks.

This method is quite useful as it reduces or prevent foaming of the carbonated liquid during filling, thereby optimizing the filling sequence.

In case of container for carbonated liquid like for example, bottle for carbonated water, filled in a "blow-fill block" machine, a cooling step is required between the blowing and filling steps to avoid the deformation of the container, especially of the bottom of the container, during the filling step.

Conventionally, in such "blow-fill block" machine, a transfer from the blow molding unit in which the container is formed and the filling unit in which the container is filled is done. In case of container for sparkling beverage, the transfer step also includes an intermediate and mandatory cooling step for cooling down the empty container.

During the transfer between the blow molding unit and the filling unit, the cooling of the containers (bottles) is done by spraying jets of cold water (or other cooling fluids) directed over the external surface of the bottle bottom part. The water used for the cooling can be either recycled for the same function or disposed.

This mandatory cooling step using water jets presents some drawbacks.

Firstly, some water treatment should be installed to avoid microbial build-up into the loop: some quality control should also be in place, adding operational complexity.

Secondly, the disposed fluid represent a consumption of the machine with consequent cost end environmental impact.

In both cases, the quality of the incoming water used in the cooling system should be constantly monitored.

Various attempts have been made in the industry to avoid these water jets, for different reasons: reduction of water consumption, simplification in the machine and of the process.

However, until today, no efficient solution to have an efficient cooling down of the bottom of the bottle between the forming step and the filling step of the process have been found.

There is therefore a need to propose a new solution for cooling down the container to be filled in a process using a "blow-fill block" machine while keeping the advantages of the "blow-fill block" machine in term of production time and compactness of the equipment.

DEFINITIONS

A carbonated beverage is defined as a liquid that is oversaturated with carbon dioxide. Hence, these beverages contain dissolved carbon dioxide. The dissolution of carbon dioxide in the liquid, gives rise to fizz or effervescence. A common example is the dissolving of carbon dioxide in water, resulting in carbonated water.

The intended but non limited carbonated liquid of the present application may be carbonated water, carbonated flavored water, carbonated soft drinks, carbonated juices and all carbonated water based beverages.

However, today it is also possible to have other gas or a combination of gas dissolved in a liquid so as to obtain a liquid-oversatured with a gas leading to the same effervescent effect. These gas may be carbon dioxide, nitrogen, air or any combination thereof.

Hence, the wording of gasified liquid will be used along this application to designate a liquid that is oversaturated with a gas, including carbonated liquid in which the liquid is oversaturated with carbon dioxide.

SUMMARY OF THE INVENTION

In this respects, the invention provides a method for filling a thermoplastic container, comprising a mouth, with a gasified liquid having a pressure P, using a filling unit according to claim 1.

The proposed method comprises the steps of:

Positioning the container under a filling head of the filling unit, the filling head comprising a product filling valve;

Establishing fluid tight connection between the filling head and the mouth of the container;

Delivering a first volume of a first product in the container, said first volume being less than 10% of the maximum defined volume of the container;

Pressurizing the container with a gas at a pressure similar to the pressure of the gasified liquid to be filled, using at least one pressurization valve;

Filling the container under pressurized condition until its maximum defined volume with the gasified liquid, using the product filling valve;

Depressurizing the container using a venting valve;

Separating the container from the filling head;

Hence, the resulting gasified liquid in the container is a mixture of the first product and of the gasified liquid.

The proposed method makes it possible to cool down the thermoplastic material of the bottom of the container specifically at the location of the container base and then to avoid any deformation of the base while filling the container under pressurized condition with the gasified liquid.

It is to be noted that the first volume of the first product delivered during the delivering step is between 0.5 to 10% of the maximum defined volume of the container, and preferably between 1 and 5% of the maximum defined volume of the container.

This means that a small volume of liquid compared to the total volume of container is sufficient to provide efficient cooling of the bottom base of the container and all related advantages.

More particularly, during delivery of the first volume of the first product, the container is at atmospheric pressure, i.e. around 1 bar.

The base of the container will not be subject to deformation linked to the pressure (as only atmospheric pressure applies) and due to the fact that the temperature of the PET forming the base of the container is in the range of the PET glass transition temperature.

According to a further feature, the time between delivering of the first volume of the first product in the container and pressurizing the container, defined as the resident time; is between 0.1 and 5 s, according to the size, shape and volume of the container.

The resident time is smaller than the transfer time—corresponding to the necessary cooling step—used in the conventional process. Indeed, the transfer time is higher than 5 s, generally around 8 to 10 s. The proposed solution allows gaining time and having reduced time cycle.

According to a possible feature of the invention, the first product to be delivered in the container is different from the gasified liquid to be filled in the container. The resulting gasified liquid in the container is then a mixture of the first product and of the gasified liquid delivered in the container during the filling process.

This is particularly advantageous in that by using different first products and different gasified liquids, it gives the possibility to produce an important variety of sparkling beverage.

For example, if the first product is a flavored liquid concentrate and the gasified liquid is sparkling water, the resulting beverage is a flavored sparkling water.

As the concentrate may be of any type of flavor, an unlimited range of flavored sparkling water may be produced.

In particular, if the filling unit comprises several additional product tanks associated with the delivery of the first product, it may be possible to produce at the same moment (as the filling unit comprises several filling head, for example positioned on a rotation wheel), flavored sparkling water beverage of different flavor. It may then be possible to produce rainbow pack of flavored sparkling water beverage.

According to another option, the first product to be delivered in the container is the same liquid as the gasified liquid to be filled in the container.

Generally speaking, the first product may or may not be carbonated but as the volume of the first product in the container is low in comparison to the volume of the gasified liquid in the resulting gasified liquid, this has very few influence on the level of pressurization of the resulting gasified liquid.

According to another option the first product is at a temperature that is 5 to 10° C. lower than the gasified liquid.

This allows cooling down the bottom base in a quicker way which will improve the cycle time of the full process.

In addition, it may avoid having possible reaction between the first product and the gasified liquid when the gasified liquid in introduced in the container.

According to a further feature, the pressure at which the container is pressurized during the pressurizing step is between 2 and 6 bars. This pressure is higher than the atmospheric pressure (around 1 bar).

During the pressurization, the container is pressurized at a pressure that is substantially similar to the pressure of the gasified liquid to be delivered in the container.

This provides an improved control of the filling of the container and avoids having high pressure difference, between the interior of the container and the gasified liquid, involving foaming of the gasified liquid.

There is also provided an isobaric filling machine equipped with a plurality of such filling valves for filling containers with a gasified liquid.

Hence, the invention is also related to a device for filling a container according to the method for filling a container with a gasified liquid as claimed in claim 9.

The proposed device comprises a filling unit having at least one filling head in which said filling head comprises:

a product inlet for the delivery of the gasified liquid, associated with a product circuit and a product tank in which the gasified liquids is stored;

a product filling valve for dosing the gasified liquid to be delivered in the container;

a gas circuit separate from the product tank and product circuit for supplying a pressurized gas to the container;

at least one pressurization valve for pressurizing the container with the gas at high or low pressurizing flow;

an atmospheric venting circuit; and a venting valve to bring the container to atmospheric pressure, In this proposed device, the product filling valve is also used for delivering a first volume of a first product in the container at a different time from filling the container.

This is advantageous in that using same product filling valve for delivering the first product volume and the gasified liquid limits the modification needed on a conventional "blow-fill block" machine. Appropriate control means are used.

In an alternative embodiment of the proposed device, a device as claimed in claim 10 is proposed.

In this alternative device, the filling head comprises an additional product inlet dedicated to the delivery of the first gasified liquid in the container.

Hence, the proposed device comprises a filling unit having at least one filling head, said filling head comprising:

- a product inlet for the delivery of the gasified liquid, associated with a product circuit and a product tank in which the gasified liquid is stored;
- a product filling valve for dosing the gasified liquid to be filled in the container;
- a gas circuit separate from the product tank and product circuit for supplying a pressurized gas (G) to the container;
- At least one pressurization valve for pressurizing the container at high or low pressurizing flow;
- an atmospheric venting circuit; and
- a venting valve to bring the container to atmospheric pressure, In the proposed device and according to the invention, the filling head comprises an additional product inlet dedicated to the delivery of the first gasified liquid in the container.

It is to be noted that the gas used in the gas circuit is selected from the list comprising, carbon dioxide, nitrogen, air or a combination thereof.

According to a further feature, the additional product inlet is associated with an additional product filling valve. This additional product filling valve is used for filling the container with the (first volume of the) first product.

This allows better controlling the filling of the container with the first product. Indeed, valves with different flow may be used for the valve for the first product and for the valve for the gasified liquid.

According to an additional feature, the additional product inlet is associated with an additional product circuit and additional product tank.

Even if it may be considered as adding complexity to the conventional device, the advantage is important and worth implementing. It is, indeed, advantageous in that it allows making sparkling beverage with two different ingredients, for example, flavored sparkling water beverage comprising a flavored concentrate ingredients and sparkling water.

Additional product circuit and additional product tank for the first product allows having the first product at a lower temperature than the gasified liquid which may further help in the cooling of the bottom base of the container.

BRIEF DESCRIPTION OF THE DRAWINGS

The invention is further described with reference to the following examples. It will be appreciated that the invention as claimed is not intended to be limited in any way by these examples.

Embodiments of the present invention will now be described, by way of examples, with reference to the accompanying figures in which.

DETAILED DESCRIPTION

Figure 1B:
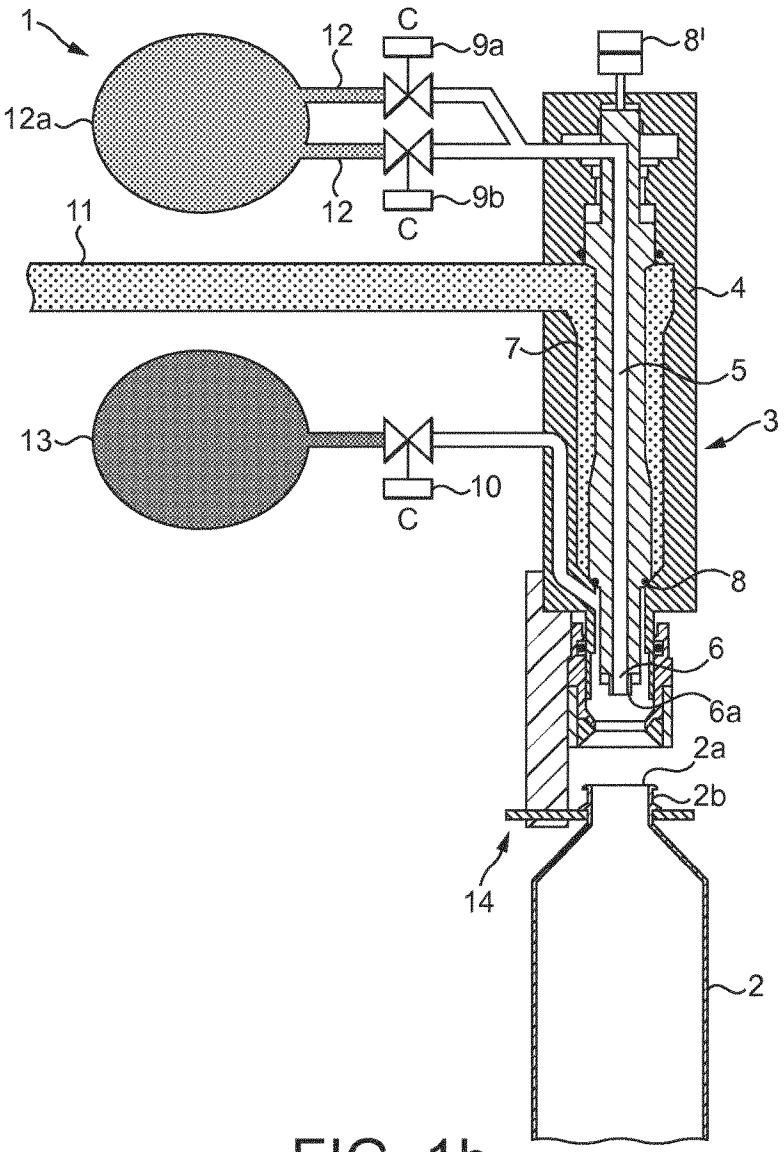
FIGS. 1*a* to 1*i* represent a cross-sectional schematic view of a filling unit of a conventional "blow-fill block" machine and associated filling process used in the prior art.

As used in this specification, the words "comprises", "comprising", and similar words, are not to be interpreted in an exclusive or exhaustive sense. In other words, they are intended to mean including, but not limited to.

Any reference to prior art documents in this specification is not to be considered as an admission that such prior art is widely known or forms part of the common general knowledge in the field.

FIGS. 1*a* to 1*i* represent part of one of a plurality of a filling unit 1 as a part of a "blow-fill block" machine of the prior art (not represented) for filling a container 2 with a carbonated liquid.

A carbonated beverage is a liquid that is oversaturated with carbon dioxide thereby containing dissolved carbon dioxide and leading to an effervescent effect.

As known, it is today possible to have other gas or a combination of gas dissolved in a liquid to lead to this effervescent effect. These gas may be carbon dioxide, nitrogen, air or any combination thereof.

Hence, the wording of gasified liquid will be used along this application to designate a liquid that is oversaturated with a gas. This wording, therefore, also designates the commonly known carbonated liquid as previously defined.

The filling unit 1 of FIG. 1*a* to 1*i* comprises a filling head 3 being able to fill containers according to an isobaric filling process known in the art. Said filling head 3 may also be designated as isobaric filling valve.

The figures from FIG. 1*a* to FIG. 1*i* also represent the different steps of the filling process currently used in "blow-fill block" machine.

Said filling unit 1 comprises a filling head 3 that is supplied with the various products used within the isobaric filling process for filling a container 2.

The filling head 3 is in the form of a cylindrical hollow housing 4 having an inner bore 5 formed around a vertical main axis X and opened to form an aperture 6 at a bottom end. At the location of the aperture 6, the filling head 3 comprises a nozzle 6*a*, for fluid tight connection to the mouth 2*a* of the container 2 to supply product to the container and thereby filling the container with a liquid.

The filling head 3 further comprises a plurality of valves with associated inlet circuits. In the present case, the filling head 3 comprises a product inlet 7, a product filling valve 8, pressurization valves 9*a*, 9*b* and venting valve 10 that are used during the isobaric filling process.

Product inlet 7 allows putting into communication the gasified liquid, in the present case carbonated liquid, storage tank and the product filling valve 8 of filling head 3 through product circuit 11. Product filling valve 8 comprises a flow meter or other volume dosing tool. Product filling valve 8 is actuated by actuator 8'.

The pressurization valves 9*a*, 9*b* comprise one valve for high gas distribution flow and one valve for a low gas distribution flow. They are used for pressurizing the container during the isobaric filling process, when the container 2 is connected to the filling head 3.

In addition to the filling head 3, the filling unit 1 comprises a carbonated liquid storage tank (not represented) for storing a carbonated liquid, and associated product circuit 11 to provide carbonated liquid to the filling head 3, gas circuit 12 associated with a gas chamber 12*a* for supplying gas to the pressurization valves 9*a*, 9*b* of filling head 3, an atmospheric venting circuit 13 associated with venting valve 10 to bring the container to atmospheric pressure when required.

A container supporting arrangement 14 is provided on the filling unit 1 to support the container 2 during its engagement with the filling head 3. The container supporting arrangement 14 may comprises a support arm (not represented) with an end in the form of a fork (not represented) to cooperate with a neck 2*b* of the container 2 which is thereby held in position to be filled through the corresponding filling head 3.

The connection between the nozzle 6*a* of the filling head 3 and the mouth 2*a* of the container 2 is made in a fluid tight manner when the container is in fluid connection with the filling head 3. Appropriate means known in the art are used.

The statement of some of the valves incorporated in the filling head 3, during the different steps of the filling process is presented with the reference C for closed or O for opened at the location of the valves or of the actuator of the valve on the figures. This representation helps understanding when and how the valves are activated during the isobaric filling process.

Conventional Isobaric Filling Process on "Blow-Fill Block" Machine of the Prior Art Conventional isobaric filling process on "blow-fill block" machine of the prior art will be described in all required details necessary to understand the general process and explain the process and modified "blow-fill block" machine of the proposed invention in the frame of filling a container with a carbonated liquid.

Figure 1A:
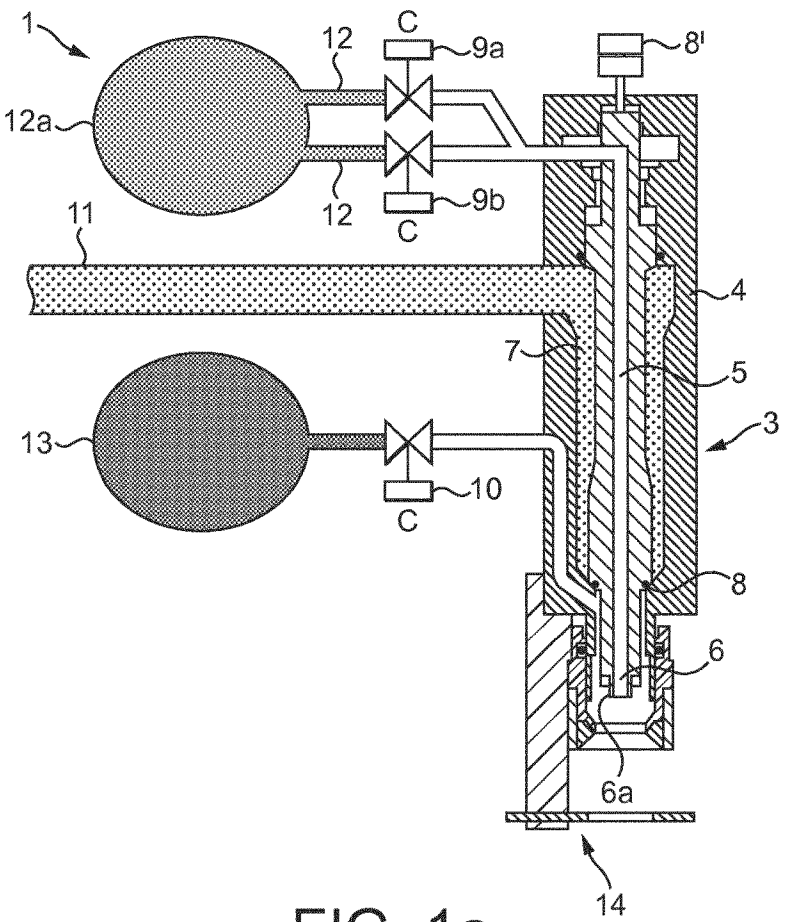
Figure 1D:
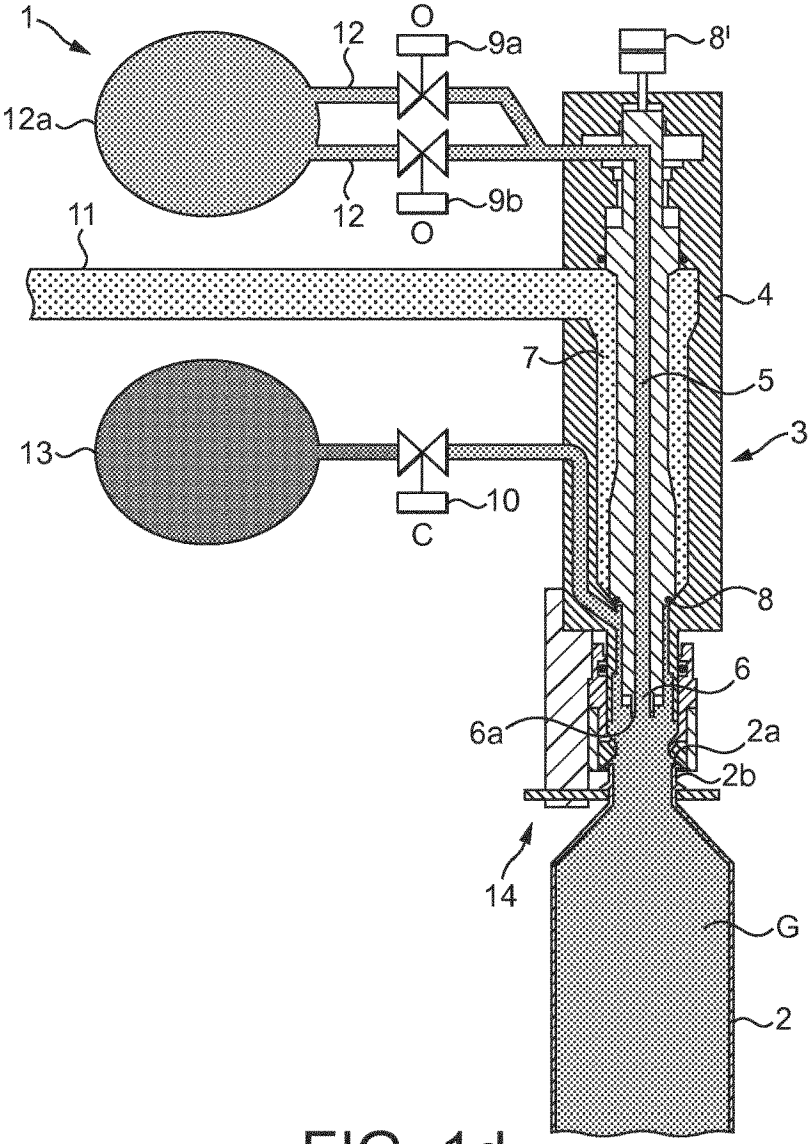

In FIG. 1*a*, the filling unit of the "blow-fill block" machine is ready to receive a container 2 newly formed in the blowing unit of the "blow-fill block" machine (not represented). The transfer of the container between the blowing unit and the filling unit is defined as the transfer step. The transfer step integrates a cooling step for cooling the empty container to avoid deformation of the container during pressurizing and filling.

During the transfer, cooling means are used to cool down the container. Conventional means are jets of cold water or other cooling fluid are sprayed against the bottom surface of the container.

The transfer time, time of the transfer step integrating the above cooling step, generally takes around 8 to 10 s which is quite long in relation to the full forming and filling process. This transfer time may even be longer in case of large containers.

As will be understood, in the conventional process, the transfer step is lengthened in time in comparison to the sole transfer for blowing unit to filling unit as it integrate a necessary cooling step.

Prior to the represented state in FIG. 1*a*, the container has been cooled down by cooling means (not represented) during the transfer from the blowing unit to the filling unit (transfer step).

In FIG. 1*a*, the pressurization valves 9*a*, 9*b* are closed as well as the venting valve 10 (C state). The state of the valves is indicated directly at the location of the valve or at the location of the valve actuator with a reference sign on the figure: O for opened and C for closed.

As depicted in FIG. 1*b*, an empty container 2 is transferred to the filling unit and is held by the container supporting arrangement 14. Pressurization valves 9*a*, 9*b* and venting valve 10 are in a closed position.

Figure 1C:
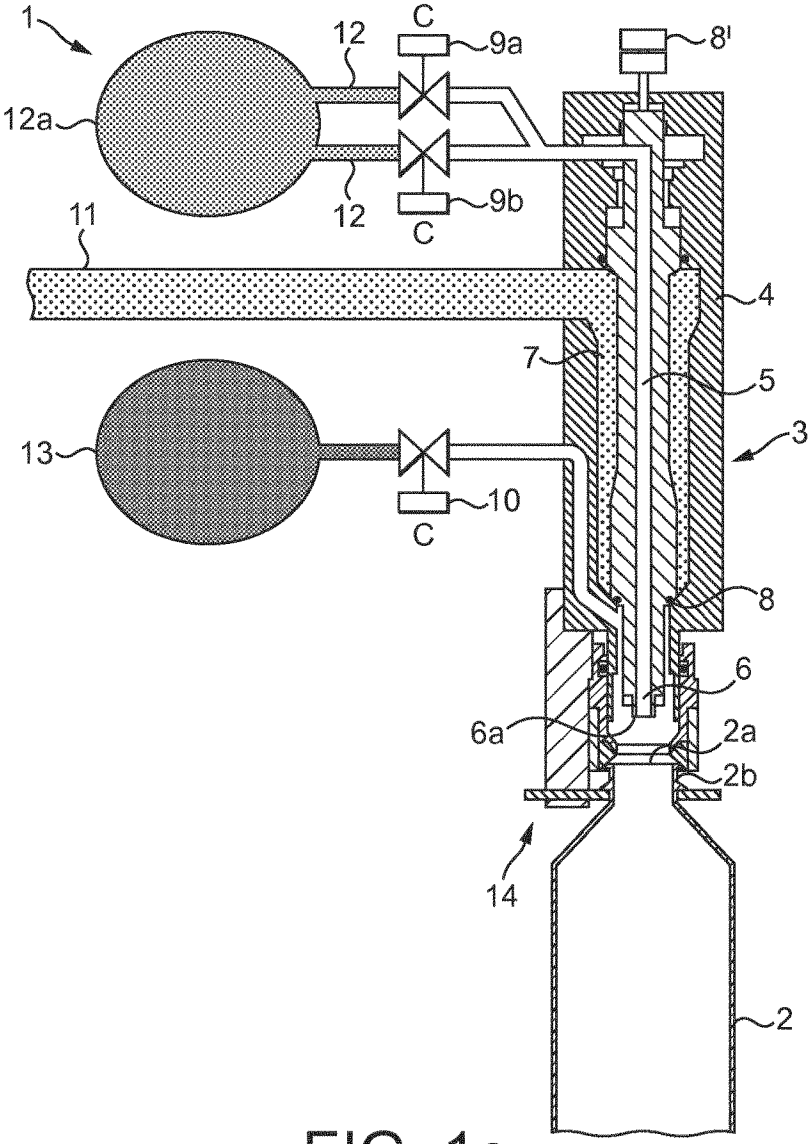

In FIG. 1*c*, the container 2 is brought in fluid tight connection with filling head 3.

Once the container is in place on the filling head 3 with fluid tight connection, the container is pressurized. On FIG. 1*d*, it can be seen that the pressurization valves 9*a*, 9*b* are opened allowing gas to enter in the container 2 though the filling head 3. The gas that is used is conventionally carbon dioxide but it can also be nitrogen, air or any combination thereof.

Both pressurization valves 9*a*, 9*b* are shown as being opened 9*a*, 9*b* at the same time but they can be opened at different times and for different time period depending on their flow. They can also be opened alternatively. The opening of the pressurization valves 9*a* and 9*b* is controlled by appropriate controlling means.

The other valves, venting valve 10 and product filling valve 8, are closed.

The container is pressurized at a pressure between 2 and 6 bars, depending on the pressure of the carbonated liquid to be filled in the container. For example for a carbonated liquid at a pressure of about 3 to 4, the container 2 will be pressurized at a pressure of about 3 to 6 bars.

Figure 1F:
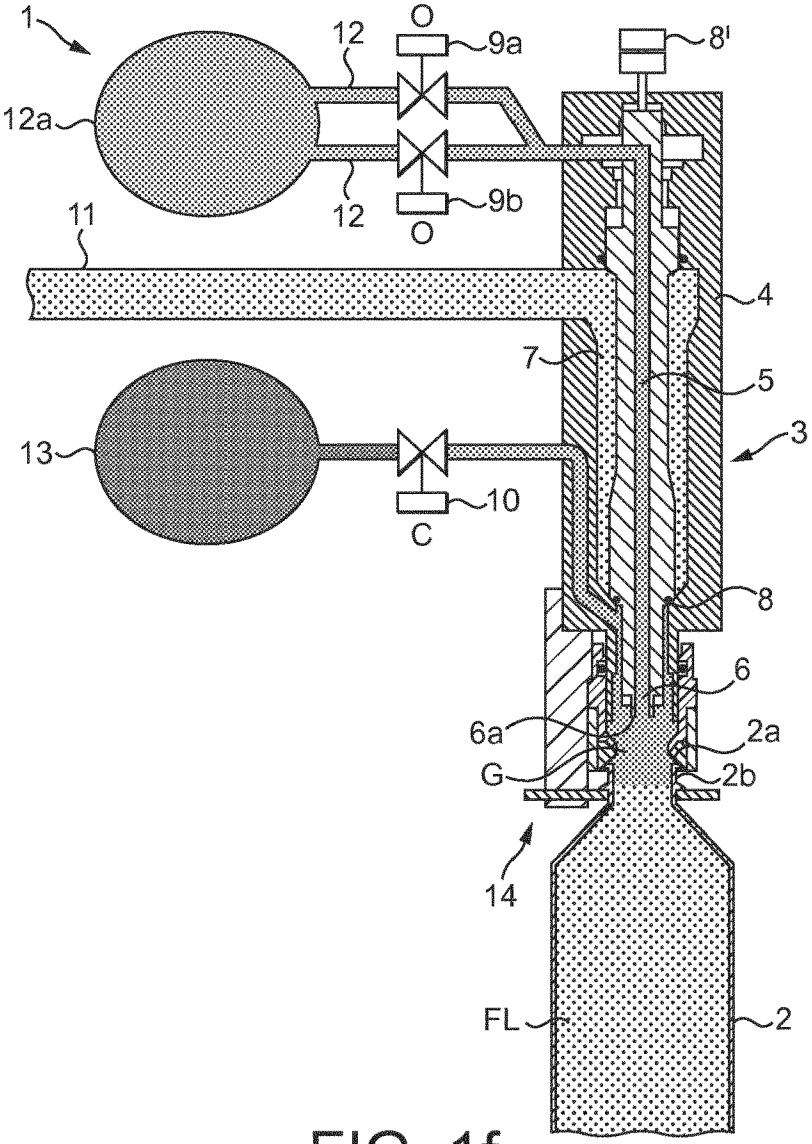
Figure 1E:
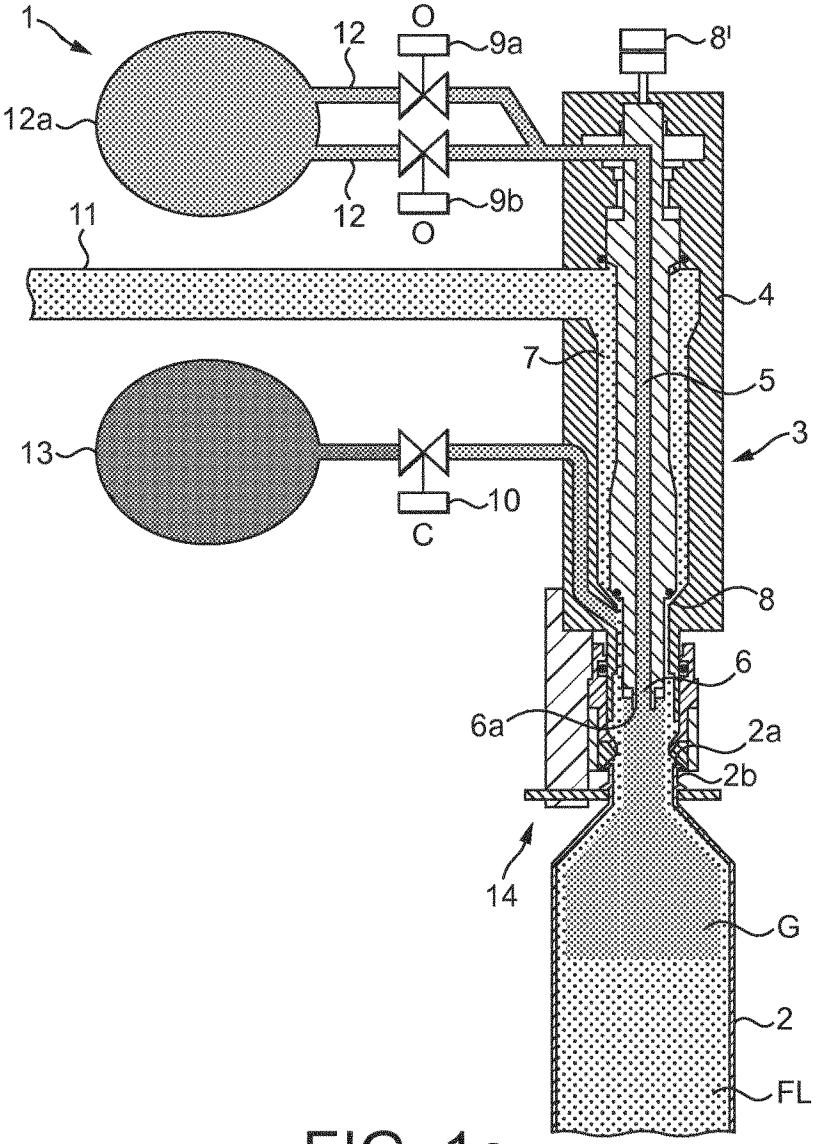

Once the container is under pressure, and kept under pressure with the pressurization valves 9*a*, 9*b* opened (O state), the product filling valve 8 is opened (actuator 8' in O state) and the carbonated liquid CL flows into the container to fill it as can be seen in FIGS. 1*e* and 1*f*.

During the filling of the container with the carbonated liquid, the carbonated liquid CL is allowed to flow from the product tank (not represented) to the container 2 through the product inlet 7 and product filling valve 8, until a flow meter (not represented) integrated in the control system of the filling unit 1 has measured the total amount of liquid substantially corresponding to the volume of the container 2.

Figure 1H:
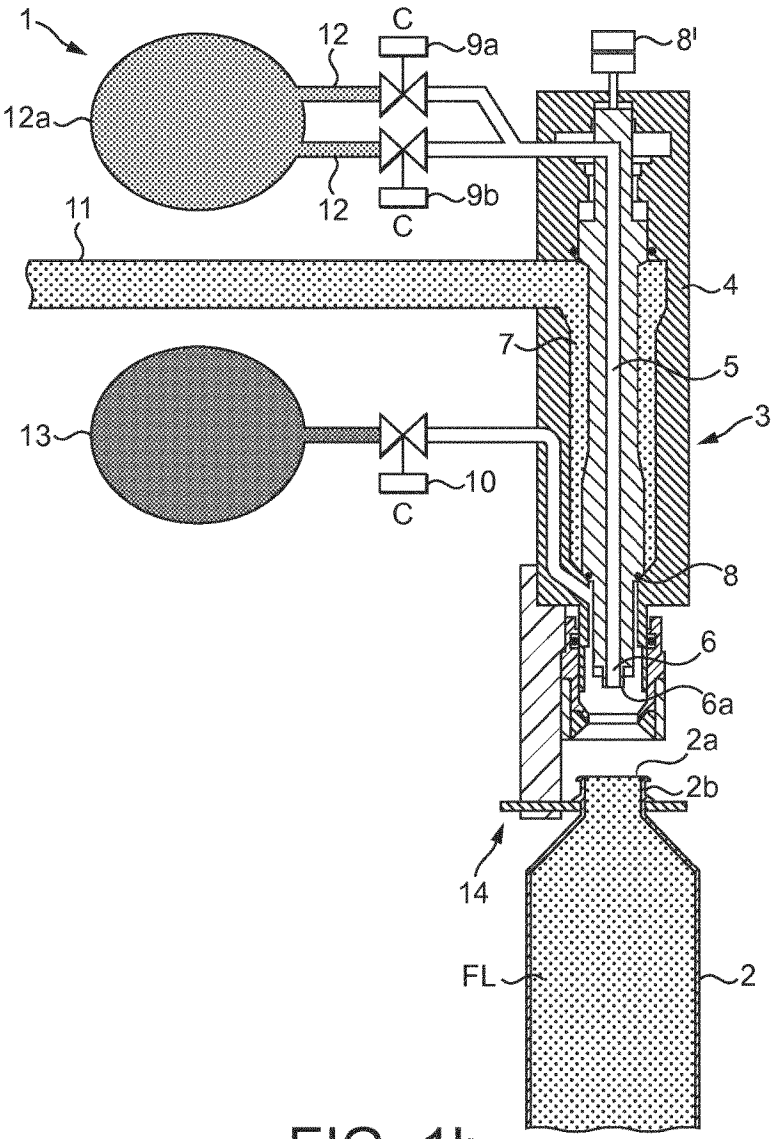
Figure 1G:
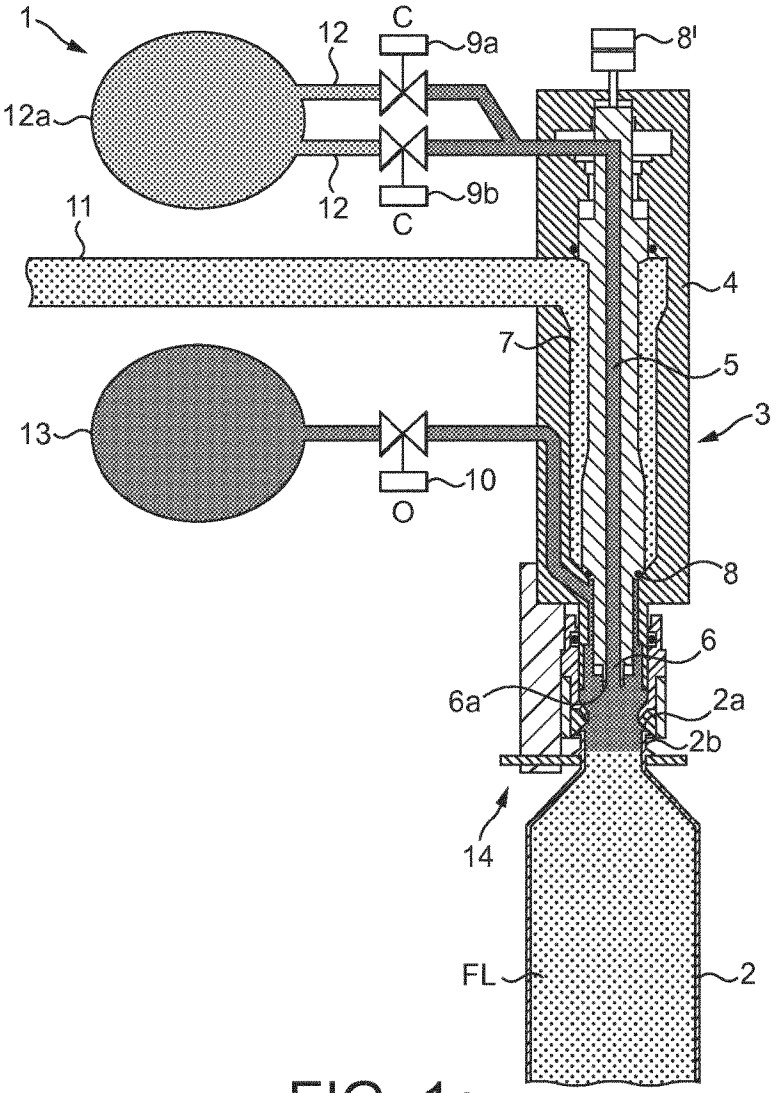

When the container 2 is fully filled with the carbonated liquid CL, as presented in FIG. 1*g*, the product filling valve 8 and the pressurization valves 9*a*, 9*b* are closed (C state) and further, the venting valve 10 is opened (O state). The container is then put at atmospheric pressure.

The venting valve is then after closed and the container 2 is then ready to be disconnected from the filling head 3 as presented in FIG. 1*h*.

Figure 1I:
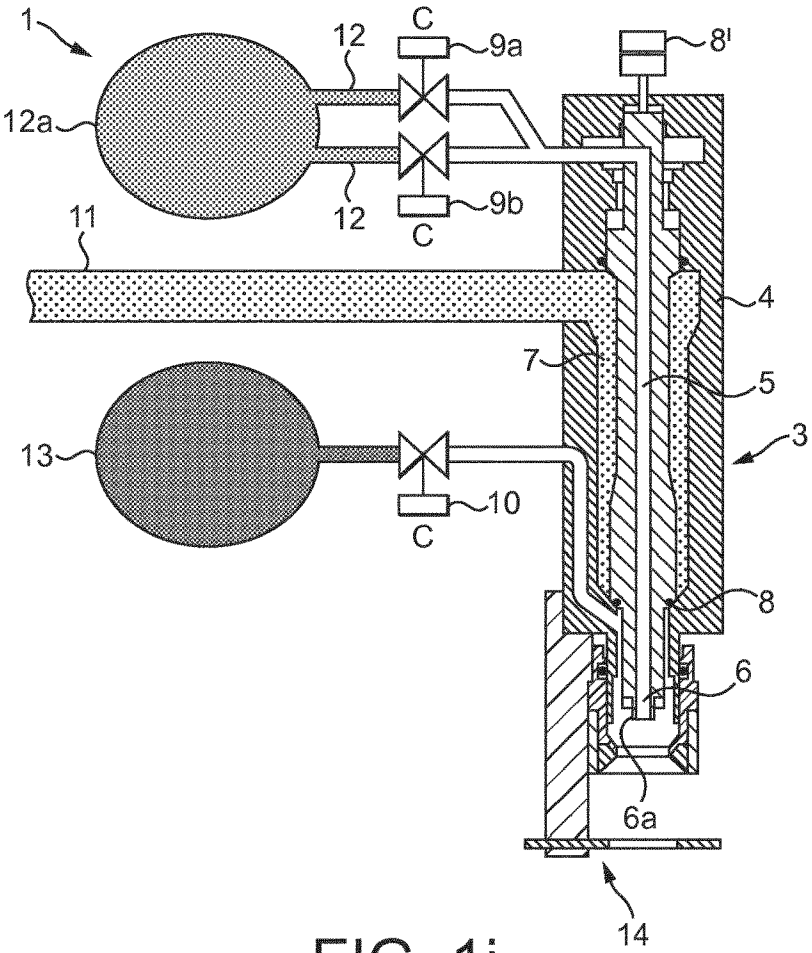

Venting of the container 2 prevents the carbonated liquid from foaming when the container 2 is separated from the filling head 3 at the end of the filling In FIG. 1*i*, the container 2 is taken away from the filling unit 1 and the filling unit 1 is in ready to get a new container to fill. The filling unit 1 is in the same state as the one presented in FIG. 1*a*.

New Proposed Isobaric Filling Process on Conventional "Blow-Fill Block" Machine In a first embodiment of the invention, it is proposed a new isobaric filling process that is implemented on a conventional "blow-fill block" machine as the one described in connection with FIG. 1*a*.

In the present example and in connection with the claims, first product FL and gasified liquid PL are both the same gasified liquid for example a carbonated liquid.

Figure 2A:
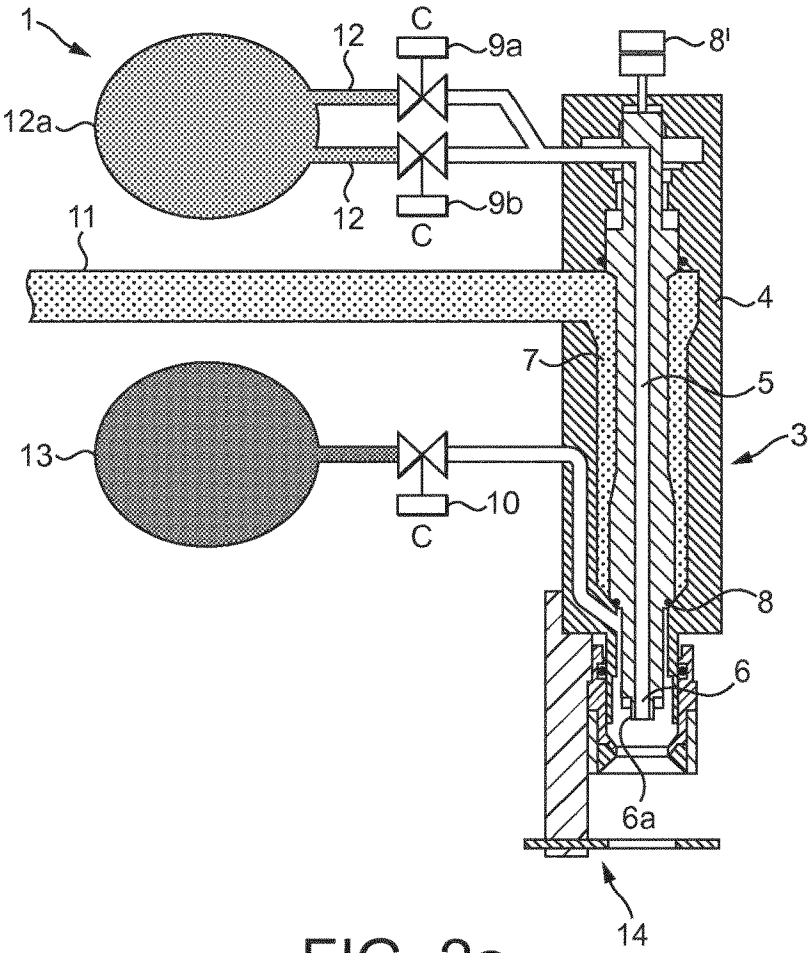
FIGS. 2*a* to 2*e* represent a cross-sectional schematic view of the filling unit of a "blow-fill block" machine of the invention with associated additional steps for the isobaric filling process according to a first embodiment of the invention.

Hence, as depicted in FIG. 2*a*, the filling unit 1 of the "blow-fill block" machine is ready to receive a container 2 newly formed in the blowing unit of the "blow-fill block" machine (not represented). The pressurization valves 9*a*, 9*b* are closed as well as the venting valve 10 (C state) and the product filling valve 8 (as presented on actuator 8').

In this embodiment, the transfer time between the blowing unit and the filling unit may be reduced to the minimum as no cooling is necessary.

Figure 2C:
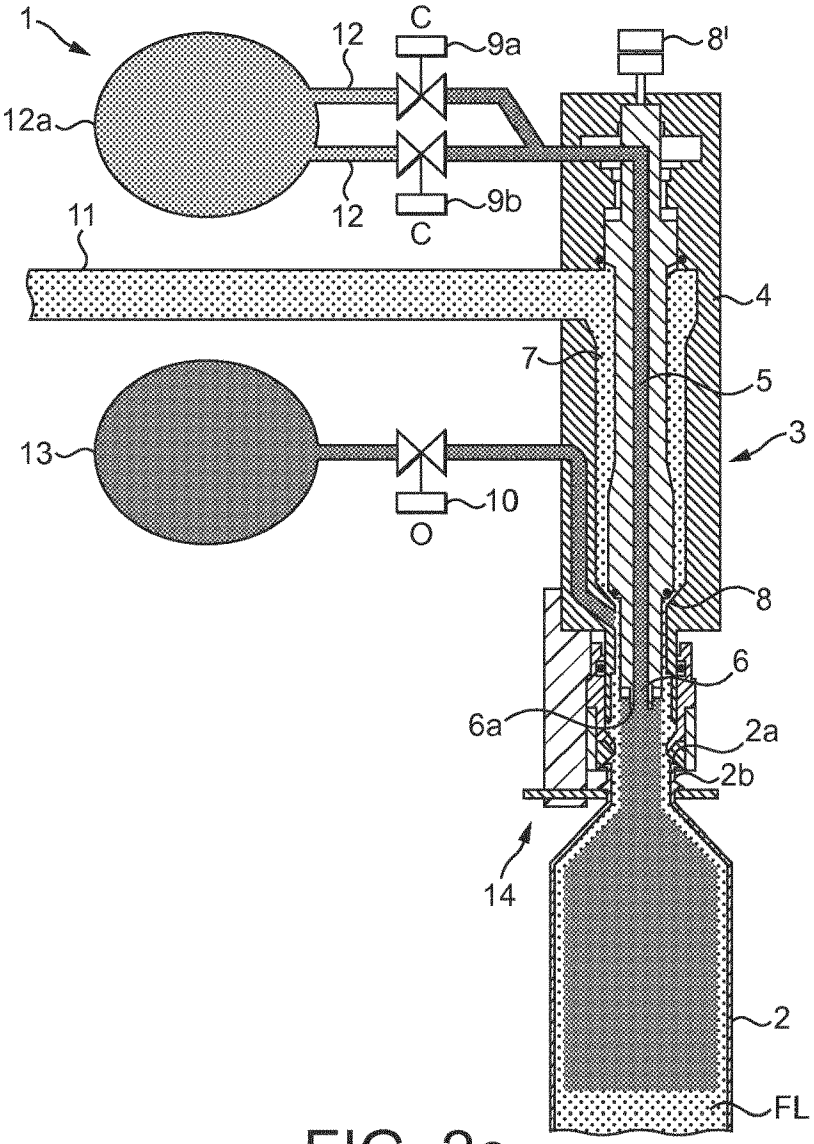
Figure 2B:
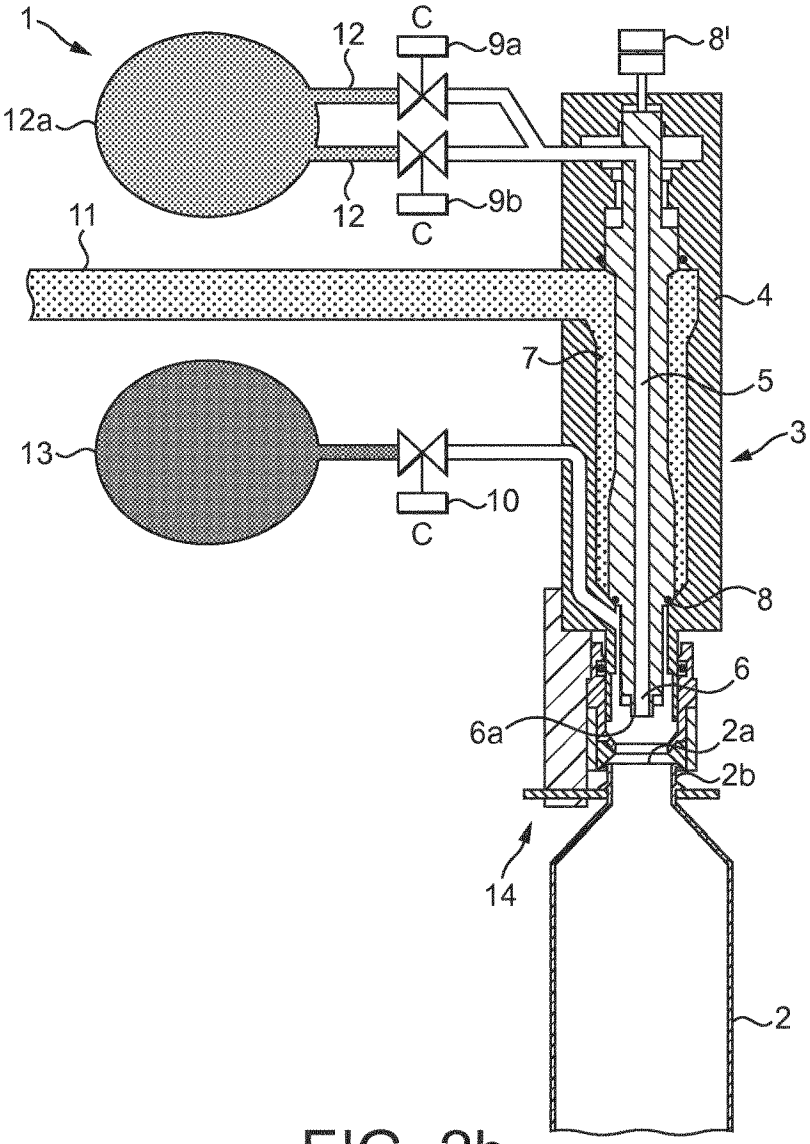

In FIG. 2*b*, an empty container 2 is transferred to the filling unit 1 and is held by the container supporting arrangement 14. Product filling valve 8, pressurization valves 9*a*, 9*b* and venting valve 10 are in a closed position (C state).

According to the first embodiment of the present invention and as shown in FIG. 2*c*, once connected and in fluid connection with the filling head 3, the container 2 is put at atmospheric pressure via opening of the venting valve 10 (O state). A first volume of carbonated liquid FL is delivered by opening of the product filling valve 8 for a given time (actuator 8' of product filling valve 8 in O state).

The carbonated liquid flow is then stopped under control of a flow meter (not represented) when the required volume of carbonated liquid is delivered to the container 2.

The first volume of carbonated liquid FL that is introduced in the container 8 is between 0.5 and 10% of the maximum defined liquid volume to be filled in the container and preferably between 0.5 and 5%, and most preferably between 1 and 5%. For example, for a 500 ml bottle, the first volume of carbonated liquid delivered in the bottle is between 5 and 20 ml.

This first volume of carbonated liquid when introduced in the container covers the internal bottom base of the container and thereby allows it to cool down quickly. The fact that the carbonated liquid is at ambient temperature is enough to have a cooling effect on the bottom base of the container 2.

During delivery of the first volume of carbonated liquid, the venting valve 10 is opened (O state).

Figure 2E:
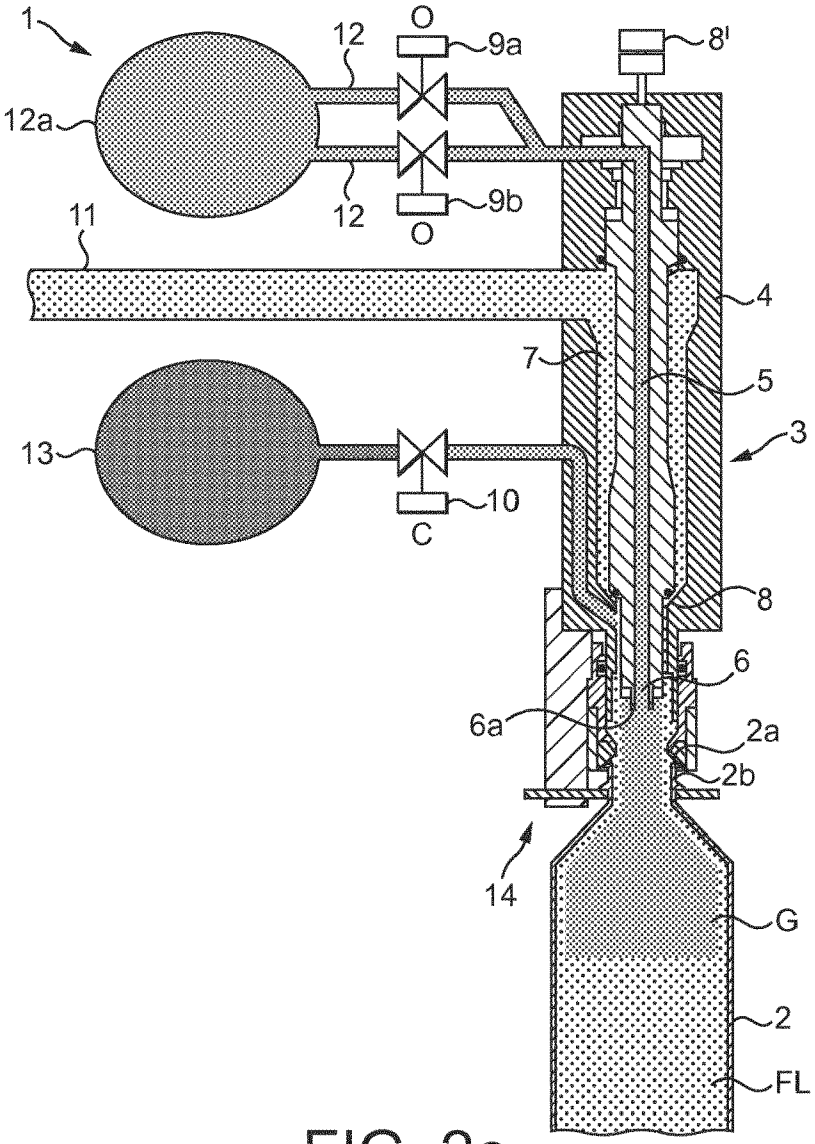
Figure 2D:
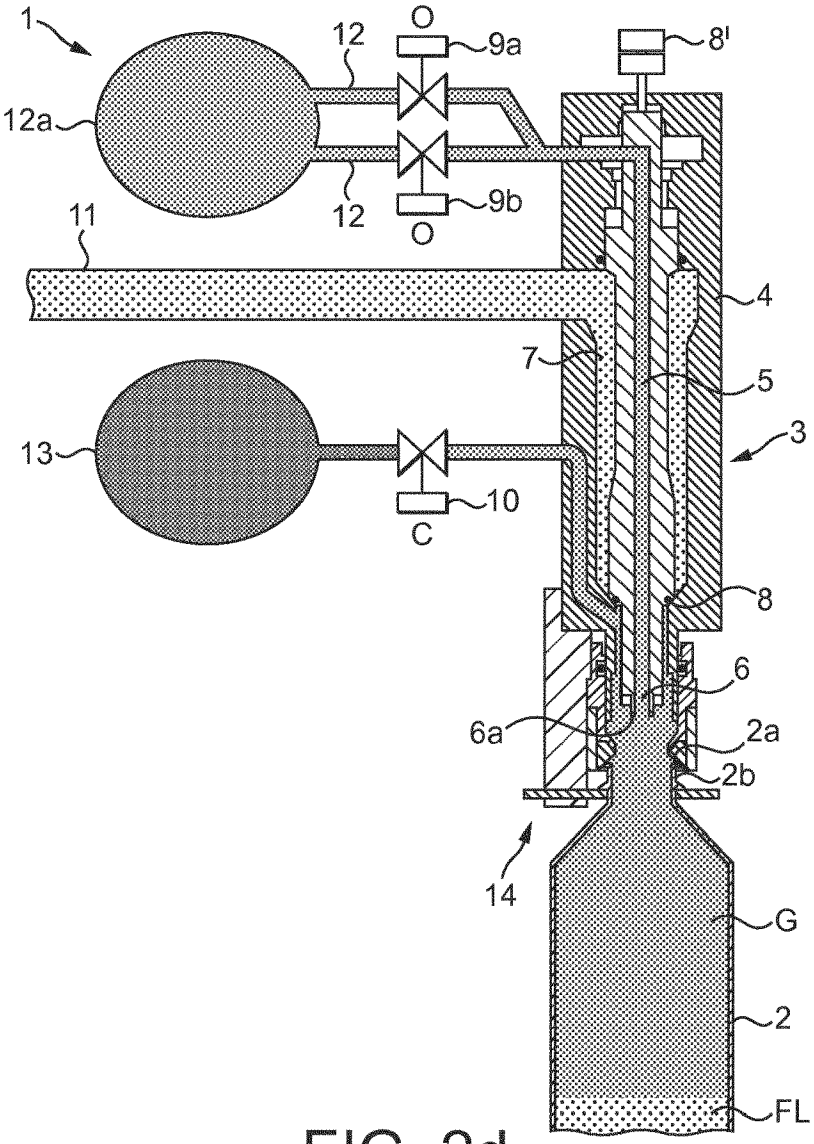

The next step of the proposed process, as presented in FIG. 2*d*. The venting valve 10 and the product filling valve 8 are closed and the container 2 is pressurized by opening of the pressurization valves 9*a*, 9*b*. The container 2 is then under gas G pressure at a pressure between 2 and 6 bars.

The container 2 is pressurized after the first carbonated liquid FL has stayed for a defined period in the container.

A resident time of the first carbonated liquid FL in the container 2 is then defined as the time between the delivery of the first volume of carbonated liquid in the container and the step of pressurizing the container 2. The resident time is between 0.1 and 5 s.

This resident time is limited in comparison of the transfer time (integrating the mandatory cooling step) of the conventional isobaric filling process which is around 8 to 10 s.

Once the container 2 is pressurized, the product filling valve 8 is opened (O state) as presented in FIG. 2*e*. During the filling of the container 2 with carbonated liquid until its maximum defined volume, the container is under pressurized condition with gas G (pressurizing valves 9*a* and 9*b* being still opened).

The cooling of the bottom base of the container 2 has the effect that the bottom base will not deform when the container will be pressurized during the pressurization step and further completely filled with the carbonated liquid.

The following steps, namely, full filling of the container 2 with the carbonated liquid, venting of the container 2 by opening of the venting valve 10, and separation of the container 2 from the filling head 3, are similar to steps described in connection with FIGS. 1*f* to 1*i*.

In connection with the claims, and with the present embodiment, the first product FL delivered in the container (first volume of first product delivered as presented in FIG. 2*c*) is the same product as the gasified liquid PL that is filled in the container.

As noticed, in the proposed embodiment, the product filling valve 8 is also used for delivering both the first volume of a first product FL in the container and for delivering the gasified liquid PL in the container.

Clearly, appropriate control means are used to first deliver the first product volume and secondly deliver the pressurized product.

New Proposed Isobaric Filling Process on Modified "Blow-Fill Block" Machine

In a second embodiment of the invention, it is proposed a new isobaric filling process using a modified "blow-fill block" machine.

In this embodiment as in the one previously described, the first product FL delivered in the container (first volume delivered) is the same as the gasified liquid PL that is filled in the container.

In the present example and in connection with the claims, first product FL and gasified liquid PL are both the same gasified liquid, for example a carbonated liquid.

Figure 3B:
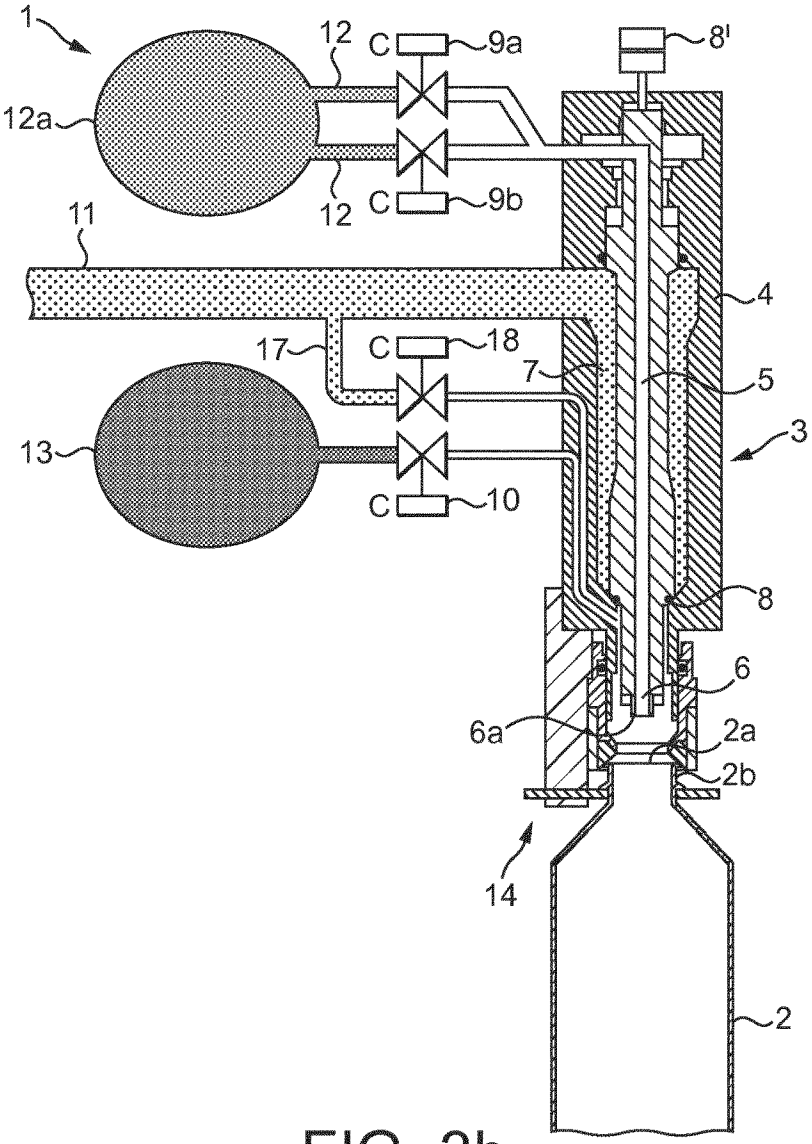
FIGS. 3*a* to 3*e* represent a cross-sectional schematic view of a modified filling unit of a "blow-fill block" machine according to the invention with additional process steps according to a second embodiment of the invention.
Figure 3A:
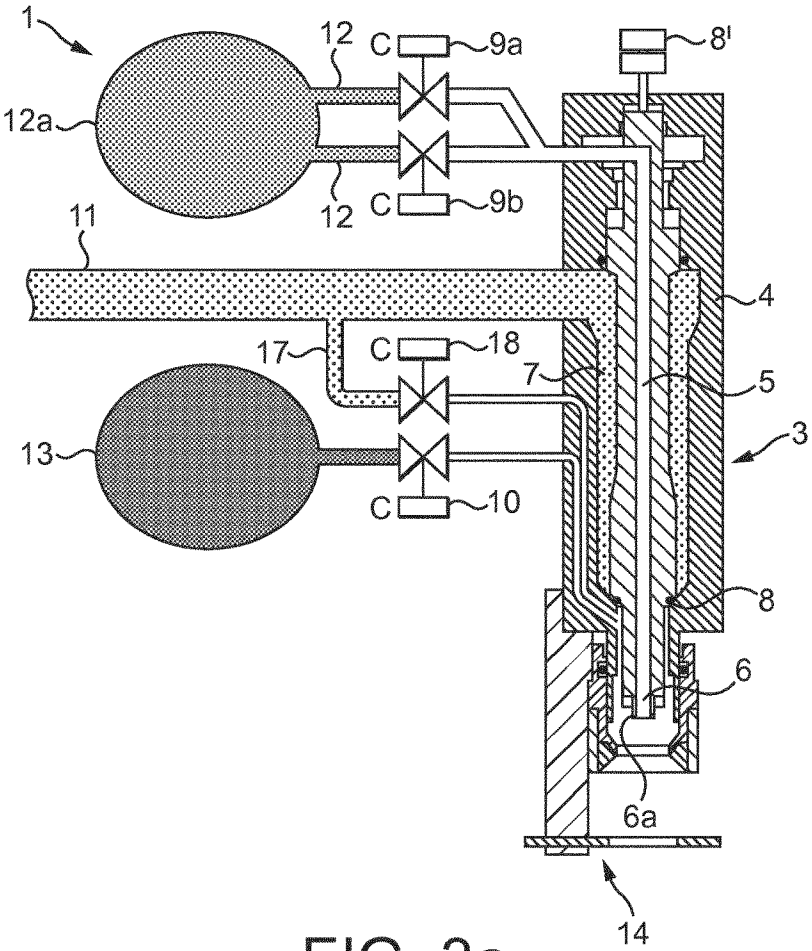

The modified "blow-fill block" machine is presented in FIG. 3*a* in which the product circuit 11 comprises an additional pipe 17 and an additional product valve 18 enabling providing carbonated liquid to the filling head 3 for supplying according to a second route carbonated liquid directly into the container 2.

The additional product valve 18 allows providing carbonated liquid in small and precise quantity into the container while the product filling valve 8 is a high speed filling valve. Hence additional product valve 18 provides better control of the quantity of carbonated liquid FL delivered (First volume of first product).

Additional product valve 18 state is presented in the diagram associated with each figure under the reference 18.

Figure 3D:
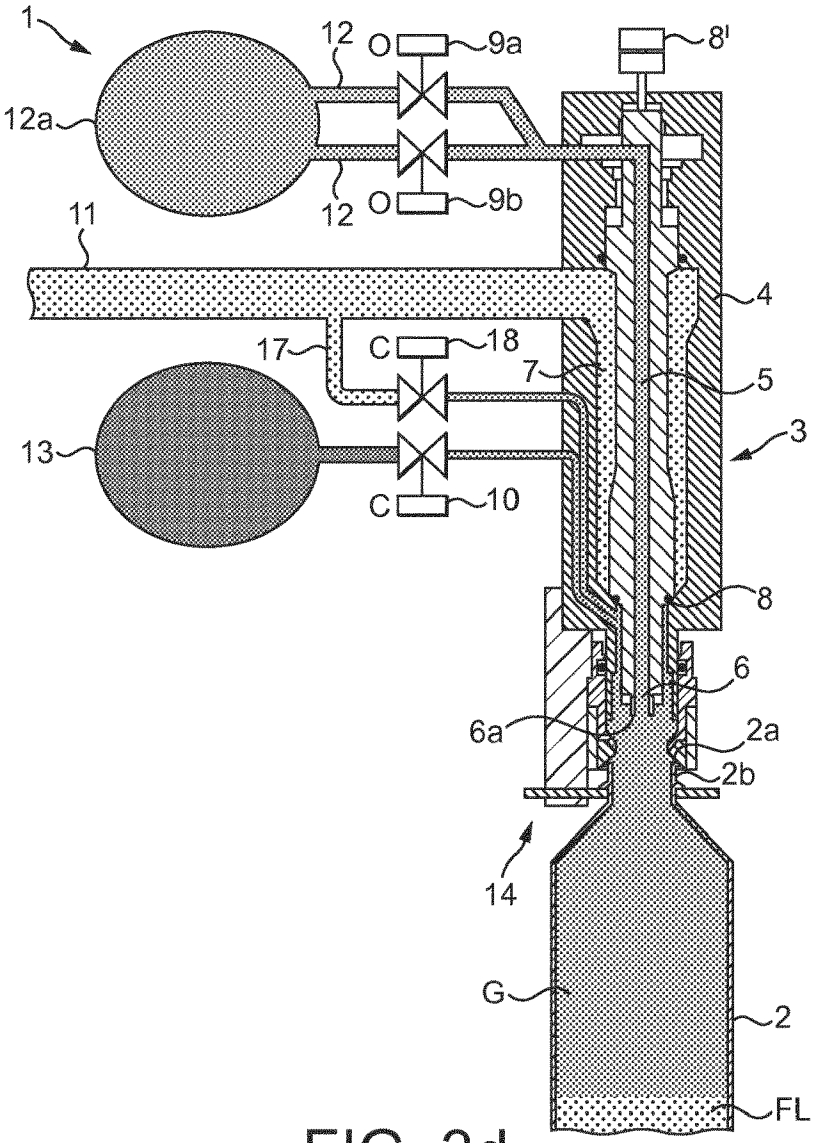
Figure 3C:
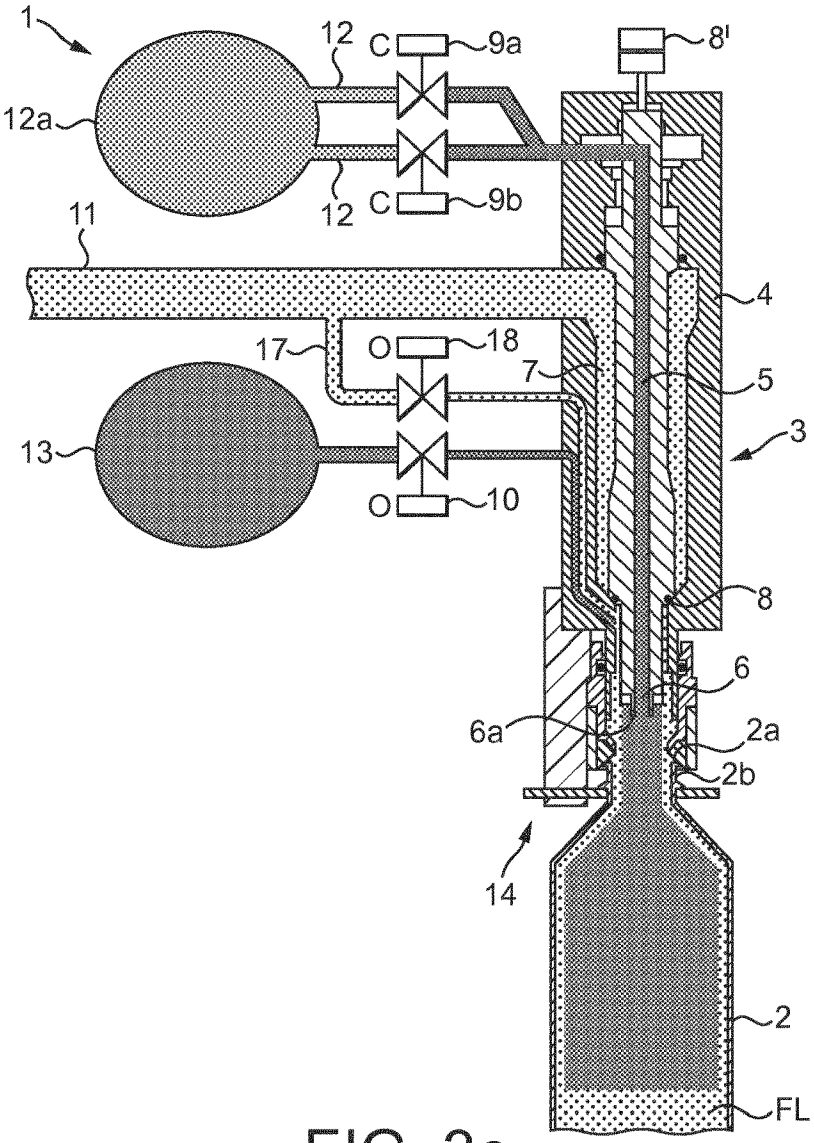

In the proposed embodiment, once the container 2 is positioned under the filling unit and in fluid tight connection with the filling head 3 (FIG. 3*b*), the container is put at atmospheric pressure by opening of the venting valve 10 (O state) and the supplemental valve 18 is opened to supply the first volume of carbonated liquid in the container 2 as presented in FIG. 3*c*.

Further as depicted in FIG. 3*d*, both venting valve 10 and additional valve 18 are then closed and the pressurization valves 9*a* and 9*b* are further opened for pressurizing the container 2 with gas G before its filling.

As previously explained, the first volume of carbonated liquid introduced into the container will accommodate at the bottom of the container at the location of the bottom base and will cool down the thermoplastic material forming the bottom base.

Figure 3E:
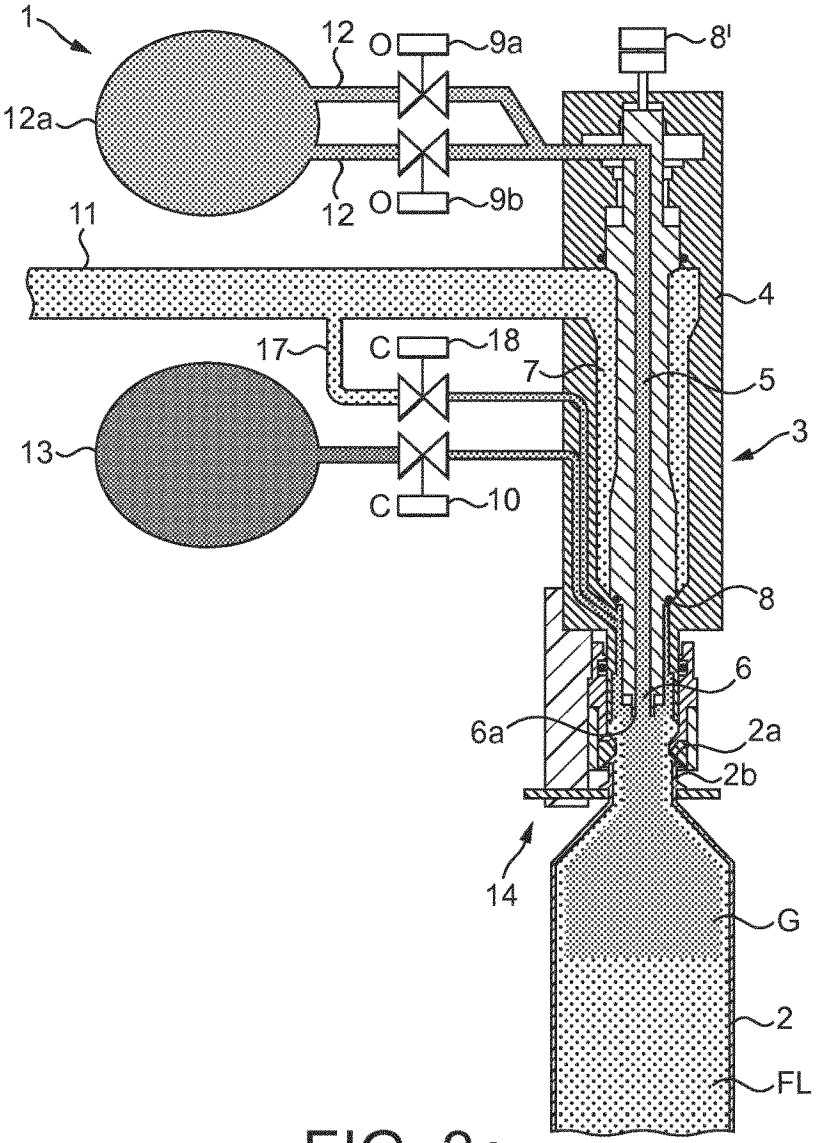

The next step is the filling of the container with carbonated liquid until its maximum defined volume under pressurized condition (pressurization valves 9*a* and 9*b* being still opened) by opening of the product filling valve 8 (actuator 8'), as represented in FIG. 3*e*.

The following steps, namely, full filling of the container 2 with the carbonated liquid (FL for instance here), closing of the pressurization valves, venting of the container 2 by opening of the venting valve 10, and separation of the container 2 from the filling head 3, are similar to steps described in connection with FIGS. 1*f* to 1*i*.

New Proposed Isobaric Filling Process on a Further Modified "Blow-Fill Block" Machine In a third embodiment of the invention, it is proposed a new isobaric filling process using a further modified "blow-fill block" machine.

Figure 4A:
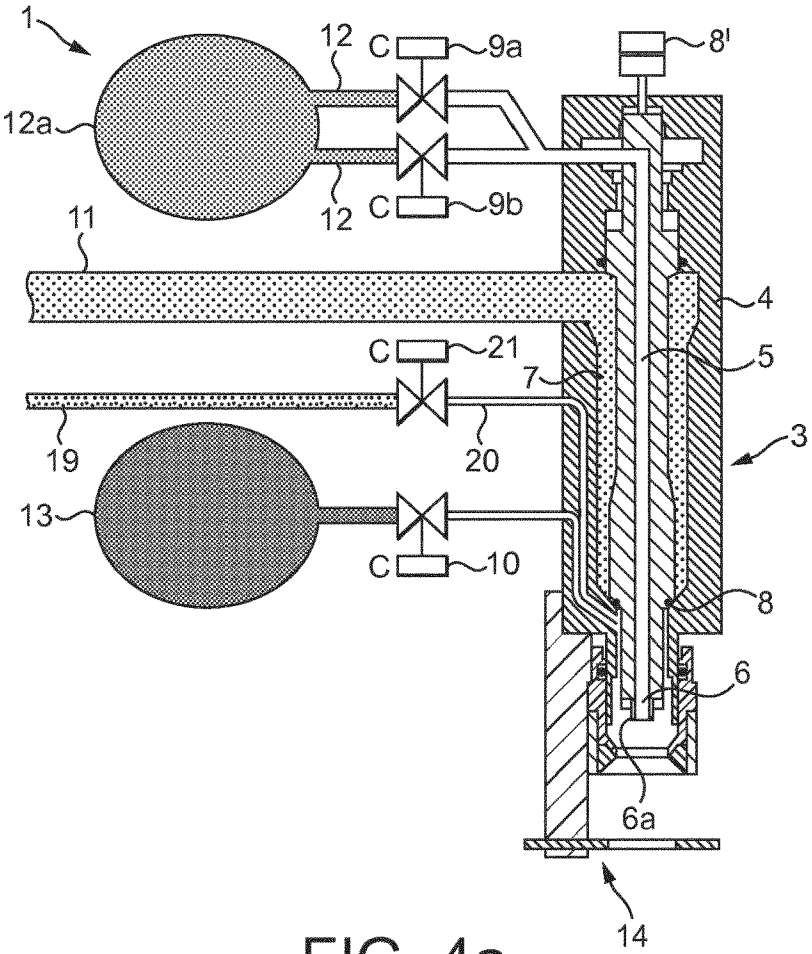
FIGS. 4*a* to 4*e* represent a cross-sectional schematic view of a further modified filling unit of a "blow-fill block" machine according to the invention with additional process steps according to a third embodiment of the invention.

In comparison with the previous embodiment (presented in FIGS. 3*a* to 3*e*), this further modified "blow-fill block" machine (of FIGS. 4*a* to 4*e*) comprises an additional product circuit 19 and associated additional product tank (not represented). This additional product circuit 19 comprises an additional product inlet 20 connected to an additional product valve 21. This is presented in FIG. 4*a*.

Figure 4C:
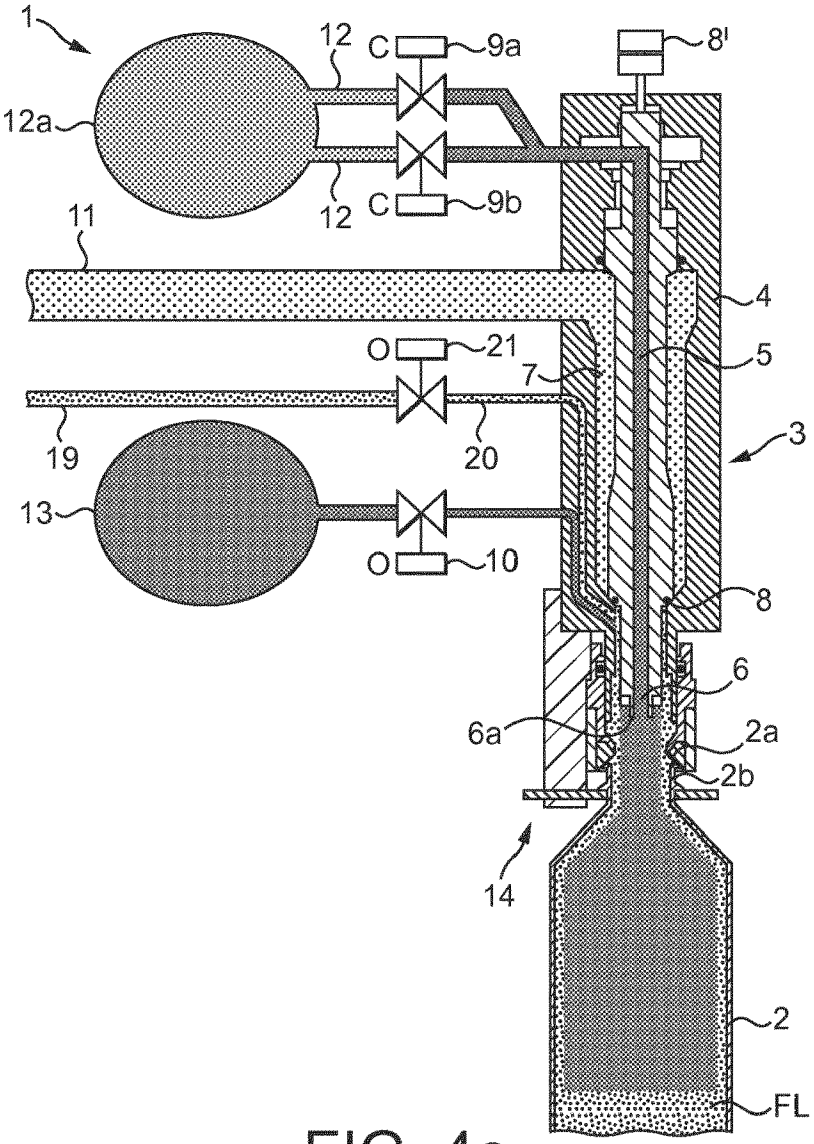
Figure 4B:
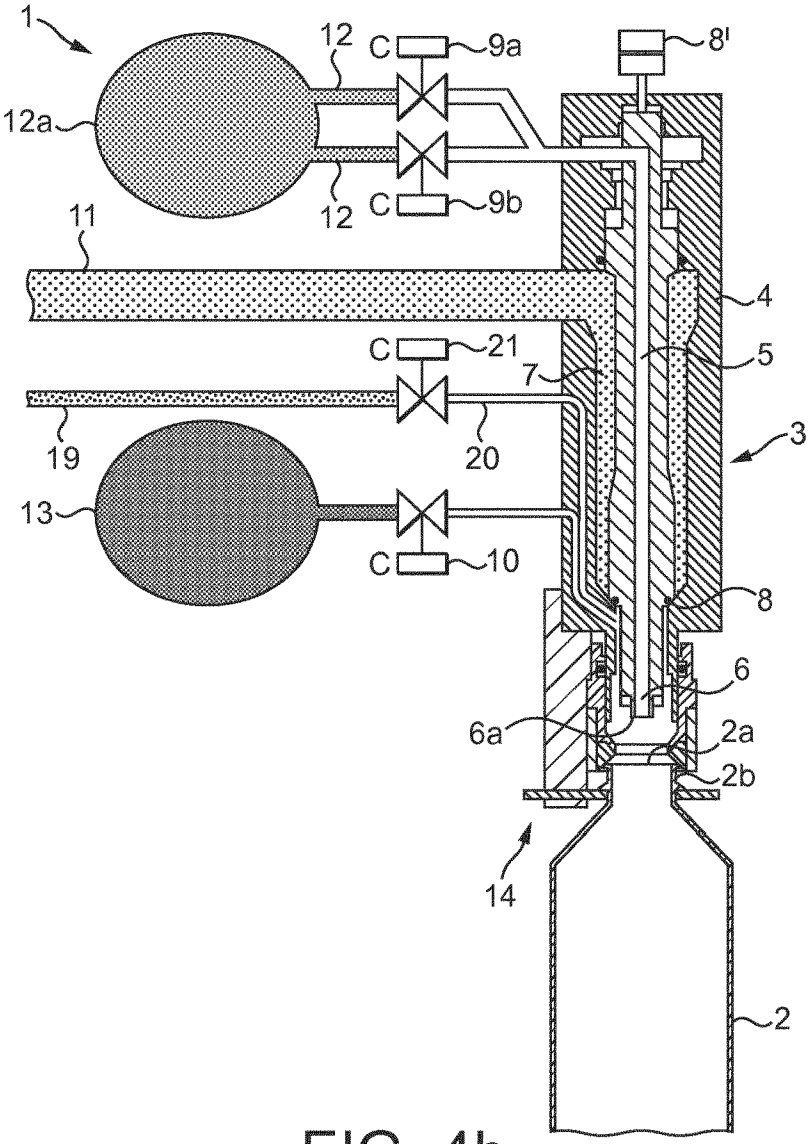
Figure 4E:
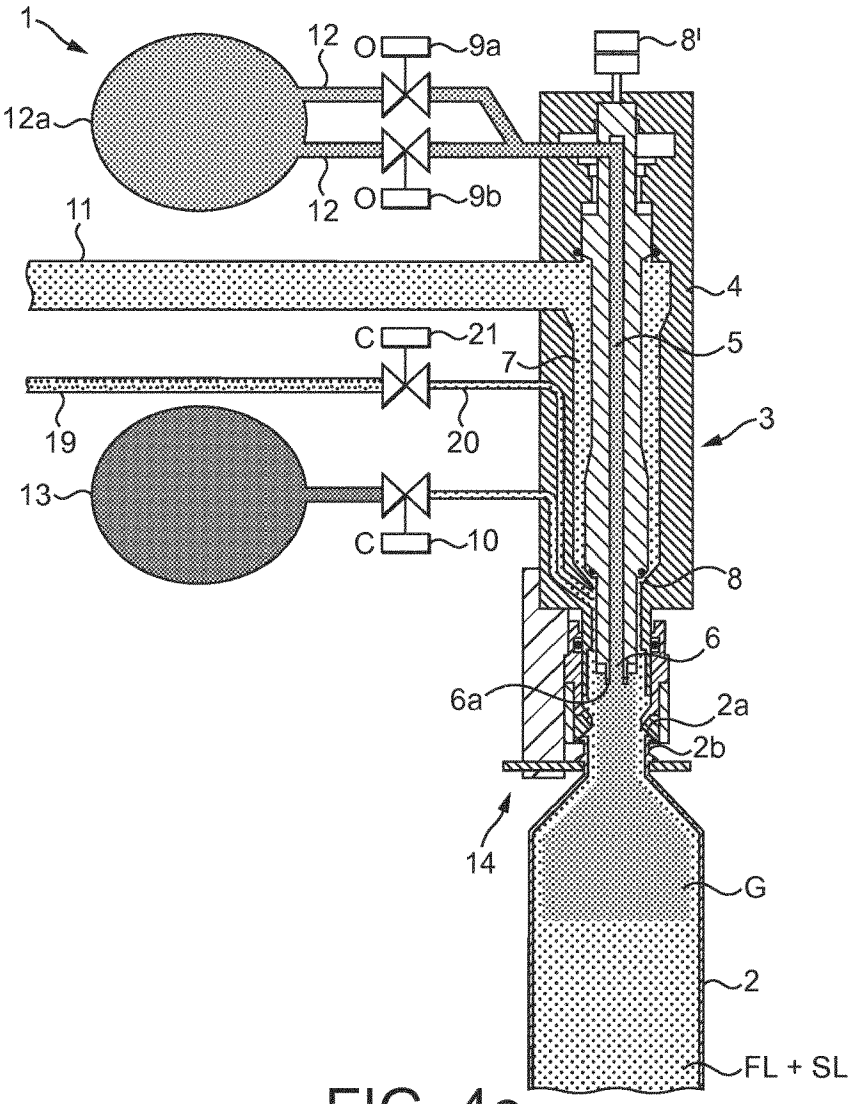
Figure 4D:
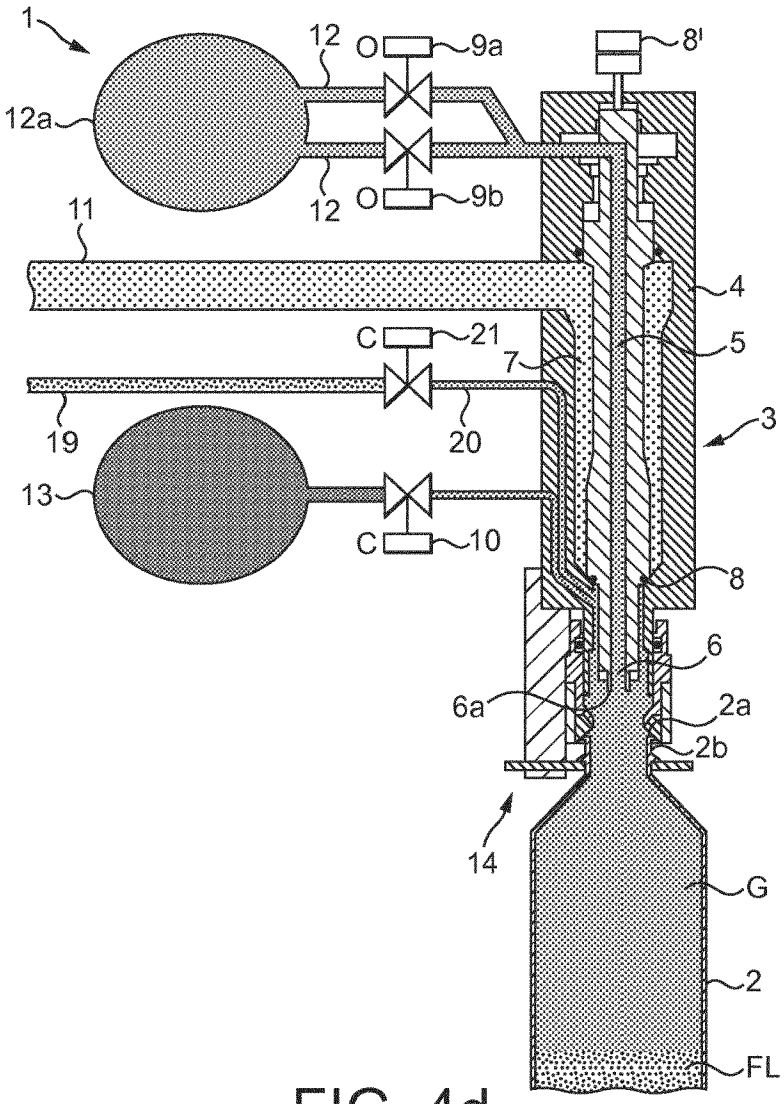

In this third embodiment and as depicted in FIGS. 4*a* to 4*e*, once the container is in fluid tight connection with the filling head 3 (FIG. 4*b*), it proposed to deliver a first volume of a first product FL in the container 2 maintained at atmospheric pressure (venting valve 10 and additional product valve 21 opened) as presented in FIG. 4*c* and then (after closing of venting valve 10 and additional product valve 21) to pressurized the container with gas G under pressure (opening of pressurizing valves 9*a*, 9*b*) as proposed in FIG. 4*d* and fill the container 2 under pressurized condition with a second liquid that is a gasified liquid PL (for example, carbonated liquid) by opening of product valve 8 (actuator 8' in O state) as presented in FIG. 4*e*.

The temperature of the first volume of the first product FL stored in the additional product tank (not represented) in connection with addition product circuit 19 and that is injected in the container during the step presented in FIG. 4*c* is 5 to 10° C. lower than the gasified liquid PL.

This low temperature of the first product FL helps in cooling the bottom base of the container 2.

In the present embodiment, the first product FL and the gasified liquid PL may be different as all needed piping and circuitry are present. The first product FL may be carbonated or not while the liquid to be filled in the container is a gasified liquid PL. The resulting liquid in the container is then a mixture between the first product FL and the gasified liquid PL. As the gasified liquid PL is oversaturated with a gas and delivered in a larger quantity than the first product FL, the resulting liquid in the container is a gasified beverage.

In more detail, in the proposed embodiment, once the container 2 is positioned under the filling unit 1 and in fluid tight connection with the filling head 3 (FIG. 4*b*), the container is put at atmospheric pressure by opening of the venting valve 10. The additional product valve 21 is opened to supply the first volume of a first product FL in the container 2 as shown in FIG. 4*c*.

The additional product valve 21 is controlled through flow meter and controlling means not detailed in the present description.

The first product FL flows at the bottom of the container at the location of the base of the container 2. The thermoplastic material of the bottom base is then cooled down.

Both venting valve 10 and additional product valve 21 are further turned into a closed position and the pressurization valves 9*a* and 9*b* further opened as shown in FIG. 4*d* for pressurizing the container 2 before its filling.

FIG. 4*e* depicts the filling of the container 2 under pressurized condition (pressurization valves 9*a*, 9*b* in opened position—O state) with a second gasified liquid PL. The resulting liquid is a mixture of the first product FL and of the second gasified liquid PL.

The first product FL is in a range of 0.5 to 10% of maximum defined volume in the container 2 so that the gasified liquid PL is in a range of 99.5 to 90% in volume.

The following steps, namely, full filling of the container 2 with the second gasified liquid PL, closing of the pressurization valves 9*a*, 9*b*, venting of the container 2 by opening of the venting valve 10, and separation of the container 2 from the filling head 3, are similar to steps described in connection with FIGS. 1*f* to 1*i*.

In the present embodiment, by using different first products, it gives the possibility to produce an important variety of beverage.

For example, the first product FL may be a flavored liquid concentrate, a liquid syrup or any other flowable product having acceptable viscosity for the product to be delivered and to flow into the container, for example a fruit purée, and the gasified liquid PL, may be of any type, for example, a sparkling water, a carbonated drink or juice . . . .

Hence, as the first product FL may be of any flowable type and of any flavor and the gasified liquid PL of any gasified type, an unlimited range of flavored sparkling beverage may be produced.

In addition, if the filling unit 1 comprises several additional product tanks associated with the delivery of the first product FL to different filling heads (as the filling unit comprises several filling head, for example positioned on a rotation wheel), it may be possible to produce at the same moment flavored sparkling beverages of different flavor. It may then be possible to produce rainbow packs of flavored sparkling beverages.

Tests

Some tests have been performed to validate sufficient cooling of the bottom base of the container to avoid any deformation during pressurization of the container before its filling.

500 ml sparkling bottles having a bottom base with five peripheral feet and a central push-up portion have been used. The base of the bottle weights around 5 to 6 g PET.

The bottom clearance as proposed below is defined as the distance between the push-up portion of the bottom base and the surface on which the bottle stands. If the clearance is below 0, it means that the base has deformed and that the push up portion has collapsed.

A first volume of carbonated water is introduced in the bottle at atmospheric pressure prior to the full filling of the container under pressurized conditions with carbonated water.

| Pre-dosing (ml) of first product (water) | Samples | % of bottom bottle collapse (= clearance < 0) |
|---|---|---|
| 0 | 15 | 100% |
| 5 | 15 | 7% |
| 10 | 15 | 0% |
| 20 | 15 | 0% |

As can be seen from the above table, the addition of at least 10 ml of carbonated water (first product) prevents the bottom deformation (collapse) for all the samples.

Thermal studies on the temperature distribution of the external side of the bottom base of the bottle shows that the resistance of the bottom base after dosing is related to the cooling of the internal plastic layers of the bottom base of the bottle.

The invention proposes an alternative solution for bottom cooling based on a specific filling sequence including a specific bottom cooling step in the current forming and filling.

The solution can eliminate quality risks associated to the traditional bottom cooling as the circuit using cooling fluid jet is no longer needed.

The piping, the control devices and the bottle handling associated with this conventional bottom cooling during the transfer step between the blowing unit and the filling unit would be also removed, resulting in a simplification of the machine.

Although the invention has been described by way of example, it should be appreciated that variations and modifications may be made by the person skilled in the art without departing from the scope of the invention as defined in the claims. Furthermore, where known equivalents exist to specific features, such equivalents are incorporated as if specifically referred in this specification.

The invention claimed is:

1. A method for filling a thermoplastic container comprising a mouth, with a gasified liquid having a pressure, the method using a filling unit and comprising:

positioning the thermoplastic container under a filling head of the filling unit, the filling head comprising a product filling valve;

establishing fluid tight connection between the filling head and the mouth of the thermoplastic container;

delivering a first volume of a first product in the thermoplastic container, the first volume being less than 10% of the maximum defined volume of the thermoplastic container;

pressurizing the thermoplastic container with a pressurized gas at a pressure similar to the pressure of the gasified liquid to be filled, using at least one pressurization valve;

filling the thermoplastic container under pressurized condition until the maximum defined volume with the gasified liquid, using the product filling valve;

depressurizing the thermoplastic container using a venting valve;

separating the thermoplastic container from the filling head;

the resulting gasified liquid in the thermoplastic container being a mixture of the first product and the gasified liquid.

2. The method according to claim 1, wherein the first volume of the first product delivered during the delivering step is between 0.5 to 10% of the maximum defined volume of the thermoplastic container.

3. The method according to claim 1, wherein the first product to be delivered in the thermoplastic container is the same liquid as the gasified liquid to be filled in the thermoplastic container.

4. The method according to claim 1, wherein the pressure at which the thermoplastic container is pressurized during the pressurizing step is between 2 and 6 bars.

5. A method for filling a thermoplastic container comprising a mouth, with a gasified liquid having a pressure, the method using a filling unit and comprising:

positioning the thermoplastic container under a filling head of the filling unit, the filling head comprising a product filling valve;

establishing fluid tight connection between the filling head and the mouth of the thermoplastic container;

delivering a first volume of a first product in the thermoplastic container, the first volume being less than 10% of the maximum defined volume of the thermoplastic container;

pressurizing the thermoplastic container with a pressurized gas at a pressure similar to the pressure of the gasified liquid to be filled, using at least one pressurization valve;

filling the thermoplastic container under pressurized condition until the maximum defined volume with the gasified liquid, using the product filling valve;

depressurizing the thermoplastic container using a venting valve;

separating the thermoplastic container from the filling head;

the resulting gasified liquid in the thermoplastic container being a mixture of the first product and the gasified liquid, wherein, during delivery of the first volume of the first product, the thermoplastic container is at atmospheric pressure.

6. The method according to claim 5, wherein the first volume of the first product delivered during the delivering step is between 0.5 to 10% of the maximum defined volume of the thermoplastic container.

7. The method according to claim 5, wherein the first product to be delivered in the thermoplastic container is the same liquid as the gasified liquid to be filled in the thermoplastic container.

8. The method according to claim 5, wherein the pressure at which the thermoplastic container is pressurized during the pressurizing step is between 2 and 6 bars.

9. A method for filling a thermoplastic container comprising a mouth, with a gasified liquid having a pressure, the method using a filling unit and comprising:

positioning the thermoplastic container under a filling head of the filling unit, the filling head comprising a product filling valve;

establishing fluid tight connection between the filling head and the mouth of the thermoplastic container;

delivering a first volume of a first product in the thermoplastic container, the first volume being less than 10% of the maximum defined volume of the thermoplastic container;

pressurizing the thermoplastic container with a pressurized gas at a pressure similar to the pressure of the gasified liquid to be filled, using at least one pressurization valve;

filling the thermoplastic container under pressurized condition until the maximum defined volume with the gasified liquid, using the product filling valve;

depressurizing the thermoplastic container using a venting valve;

separating the thermoplastic container from the filling head;

the resulting gasified liquid in the thermoplastic container being a mixture of the first product and the gasified liquid, wherein a time between delivering of the first volume of the first product in the thermoplastic container and pressurizing the thermoplastic container, defined as a resident time, is between 0.1 and 5 s.

10. The method according to claim 9, wherein the first volume of the first product delivered during the delivering step is between 0.5 to 10% of the maximum defined volume of the thermoplastic container.

11. The method according to claim 9, wherein the first product to be delivered in the thermoplastic container is the same liquid as the gasified liquid to be filled in the thermoplastic container.

12. The method according to claim 9, wherein the pressure at which the thermoplastic container is pressurized during the pressurizing step is between 2 and 6 bars.

13. A method for filling a thermoplastic container comprising a mouth, with a gasified liquid having a pressure, the method using a filling unit and comprising:

positioning the thermoplastic container under a filling head of the filling unit, the filling head comprising a product filling valve;

establishing fluid tight connection between the filling head and the mouth of the thermoplastic container;

delivering a first volume of a first product in the thermoplastic container, the first volume being less than 10% of the maximum defined volume of the thermoplastic container;

pressurizing the thermoplastic container with a pressurized gas at a pressure similar to the pressure of the gasified liquid to be filled, using at least one pressurization valve;

filling the thermoplastic container under pressurized condition until the maximum defined volume with the gasified liquid, using the product filling valve;

depressurizing the thermoplastic container using a venting valve;

separating the thermoplastic container from the filling head;

the resulting gasified liquid in the thermoplastic container being a mixture of the first product and the gasified liquid, wherein the first product to be delivered in the thermoplastic container is different from the gasified liquid to be filled in the thermoplastic container.

14. The method according to claim 13, wherein the first volume of the first product delivered during the delivering step is between 0.5 to 10% of the maximum defined volume of the thermoplastic container.

15. The method according to claim 13, wherein the first product to be delivered in the thermoplastic container is the same liquid as the gasified liquid to be filled in the thermoplastic container.

16. The method according to claim 13, wherein the pressure at which the thermoplastic container is pressurized during the pressurizing step is between 2 and 6 bars.

17. A method for filling a thermoplastic container comprising a mouth, with a gasified liquid having a pressure, the method using a filling unit and comprising:

positioning the thermoplastic container under a filling head of the filling unit, the filling head comprising a product filling valve;

establishing fluid tight connection between the filling head and the mouth of the thermoplastic container;

delivering a first volume of a first product in the thermoplastic container, the first volume being less than 10% of the maximum defined volume of the thermoplastic container;

pressurizing the thermoplastic container with a pressurized gas at a pressure similar to the pressure of the gasified liquid to be filled, using at least one pressurization valve;

filling the thermoplastic container under pressurized condition until the maximum defined volume with the gasified liquid, using the product filling valve;

depressurizing the thermoplastic container using a venting valve;

separating the thermoplastic container from the filling head;

the resulting gasified liquid in the thermoplastic container being a mixture of the first product and the gasified liquid, wherein the first product is at a temperature that is 5 to 10° C. less than the gasified liquid.

18. The method according to claim 17, wherein the first volume of the first product delivered during the delivering step is between 0.5 to 10% of the maximum defined volume of the thermoplastic container.

19. The method according to claim 17, wherein the first product to be delivered in the thermoplastic container is the same liquid as the gasified liquid to be filled in the thermoplastic container.

20. The method according to claim 17, wherein the pressure at which the thermoplastic container is pressurized during the pressurizing step is between 2 and 6 bars.

* * * * *